US005426086A

United States Patent [19]

Hotta et al.

[11] Patent Number: 5,426,086

[45] Date of Patent: Jun. 20, 1995

[54] REVERSIBLE THERMOSENSITIVE RECORDING MEDIUM

[75] Inventors: Yoshihiko Hotta, Mishima; Makoto Kawaguchi; Tetsuya Amano, both of Numazu, all of Japan

[73] Assignee: RICOH Company, Ltd., Tokyo, Japan

[21] Appl. No.: 300,033

[22] Filed: Sep. 2, 1994

[30] Foreign Application Priority Data

Sep. 3, 1993 [JP] Japan ..... 5-243879

[51] Int. Cl.[6] ..... B41M 5/26

[52] U.S. Cl. ..... 503/208; 503/201; 503/214; 503/217

[58] Field of Search ..... 427/150; 503/201, 208, 503/214, 216, 217

[56] References Cited

U.S. PATENT DOCUMENTS 4,675,268 6/1987 Kishi et al. ..... 430/126
5,278,128 1/1994 Hotta et al. ..... 503/207
5,298,476 3/1994 Hotta et al. ..... 503/201

*Primary Examiner*—B. Hamilton Hess
*Attorney, Agent, or Firm*—Oblon, Spivak, McClelland, Maier, & Neustadt

[57] ABSTRACT

A reversible thermosensitive recording medium includes a reversible thermosensitive recording layer which is composed of a matrix resin and an organic low-molecular material which is dispersed in the matrix resin, the transparency of the reversible thermosensitive recording layer being reversibly changeable depending upon the temperature of the reversible thermosensitive recording layer, wherein the reversible thermosensitive recording layer has a softening initiation temperature $T_A$, the organic low-molecular-weight material has a higher crystallization temperature $T_{B1}$ which is 80° C. or more and a lower crystallization temperature $T_{B2}$, the softening initiation temperature $T_A$ is between the higher crystallization temperature $T_{B1}$ and the lower crystallization temperature $T_{B2}$, and the higher crystallization temperature $T_{B1}$ and the lower crystallization temperature $T_{B2}$ satisfies the relationship of $T_{B1}-T_{B2} \geqq 40°$ C.

22 Claims, 6 Drawing Sheets

REVERSIBLE THERMOSENSITIVE RECORDING MEDIUM

BACKGROUND OF THE INVENTION

1. Field of the Invention

The present invention relates to a reversible thermosensitive recording medium, more particularly to a reversible thermosensitive recording medium comprising a reversible thermosensitive recording layer, with the transparency thereof being reversibly changeable depending upon the temperature thereof, which is capable of recording information therein and erasing recording information therefrom repeatedly as desired by utilizing the reversibly changeable transparency of the reversible thermosensitive recording layer.

2. Discussion of Background

Recently, reversible thermosensitive recording media, which are capable of temporarily forming images or recording information therein and also capable of erasing formed images or recorded information therefrom when such formed images or recorded information becomes unnecessary, have attracted attention.

For instance, Japanese Laid-Open Patent Application 55-154198 discloses such a reversible thermosensitive recording medium provided with a thermosensitive recording layer which comprises an organic low-molecular weight material such as a higher fatty acid, which is dispersed in a matrix resin such as a vinyl chloride-vinyl acetate copolymer and whose transparency reversibly changes depending upon the temperature thereof.

Such a reversible thermosensitive recording medium, however, has the shortcomings that formed images are erased under high temperatures. This is because a higher alcohol or higher fatty acid with a melting point in the range of 60° to 80° C. is employed as the organic low-molecular-weight material, so that the reversible thermosensitive recording layer becomes transparent at temperatures in the range of 60° to 80° C.

Therefore, when such a reversible thermosensitive recording medium bears recorded images thereon and is placed at a hot place, for instance, on a dashboard of a car, which is exposed to the summer sun light, the recorded images are erased. Therefore, such a reversible thermosensitive recording medium is not suitable for use in cars, for instance, for the material for a prepaid card for toll expressway.

In order to eliminate this shortcoming of the conventional reversible thermosensitive recording medium by improving the heat resistance of formed images, a method of using a ketone with a higher alkyl group or a semicarbazone as the organic low-molecular-weight material has been proposed in Japanese Laid-Open Patent Application 3-230993. This method has made it possible to shift the transparency temperature at which the reversible thermosensitive recording layer becomes transparent to a higher temperature, so that the shortcoming that recorded images are completely erased at high temperatures has been eliminated. However, this method still has the shortcoming that the milky white degree of the reversible thermosensitive recording layer is low and accordingly the contrast of recorded images is also low.

Furthermore, in order to improve the durability of the reversible thermosensitive recording medium during repeated image formation and erasure thereof, a method of using a matrix resin having a glass transition temperature (Tg) of 80° C. or more has been proposed in Japanese Laid-Open Patent Application 4-110187.

This method is capable of solving the problem of the lowering of image contrast during the repeated use of the reversible thermosensitive recording medium to some extent, but cannot solve the problem satisfactorily.

SUMMARY OF THE INVENTION

It is therefore an object of the present invention to provide a reversible thermosensitive recording medium comprising a reversible thermosensitive recording layer whose transparency is reversibly changeable depending upon the temperature thereof, from which the shortcomings of the conventional reversible thermosensitive recording media have been eliminated, and which is capable of forming images with high contrast which are not erased inadequately at high temperatures and have excellent heat resistance, and which is also improved with respect to the repeated use durability, for instance, when a thermal head or the like is used for image formation and erasure.

This object of the present invention can be achieved by a reversible thermosensitive recording medium comprising a reversible thermosensitive recording layer which comprises a matrix resin and an organic low-molecular material which is dispersed in the matrix resin, the transparency of the reversible thermosensitive recording layer being reversibly changeable depending upon the temperature of the reversible thermosensitive recording layer, wherein the reversible thermosensitive recording layer has a softening initiation temperature ($T_A$), the organic low-molecular-weight material has a higher crystallization temperature ($T_{B1}$) which is 80° C. or more and a lower crystallization temperature ($T_{B2}$), the softening initiation temperature ($T_A$) is between the higher crystallization temperature ($T_{B1}$) and the lower crystallization temperature ($T_{B2}$), and the higher crystallization temperature ($T_{B1}$) and the lower crystallization temperature. ($T_{B2}$) satisfies the relationship of $T_{B1}-T_{B2} \geqq 40°$ C.

BRIEF DESCRIPTION OF THE DRAWINGS

A more complete appreciation of the invention and many of the attendant advantages thereof will readily obtained as the same becomes better understood by reference to the following detailed description when considered in connection with the accompanying drawings, wherein:

FIG. 3(*b*) is a side view of the thermal pressure application apparatus shown in FIG. 3(*a*).

DESCRIPTION OF THE PREFERRED EMBODIMENTS

For forming images, recording formed images and erasing recorded images, the reversible thermosensitive recording medium of the present invention utilizes the changes in transparency of the reversible thermosensitive recording layer, which is capable of forming a transparent state or an opaque milky white state reversibly. It is considered that these transparent state and opaque milky white state are formed as follows:

When the reversible thermosensitive recording layer is transparent, the particles of the organic low-molecular-weight material are dispersed in the matrix resin in close contact with the matrix resin. In other words, there are no gaps between the particles of the organic low-molecular-weight material and the matrix resin. Furthermore, there are no gaps within each particle of the organic low-molecular-weight material. Therefore, light which enters one side of the reversible thermosensitive recording layer passes through the recording layer and emits from the other side of the recording layer, without being scattered, so that the reversible thermosensitive recording layer looks transparent.

When the reversible thermosensitive recording layer is milky white, since the particles of the organic low-molecular-weight material are composed of fine crystals of the organic low-molecular-weight material, there are gaps at the interface between the crystals of the organic low-molecular-weight material and/or at the interface between the crystals of the organic low-molecular-weight material and the matrix resin, so that the light which enters one side of the reversible thermosensitive recording layer is scattered at the interfaces between the gaps and the crystals of the organic low-molecular-weight material and at the interfaces between the gaps and the matrix resin. As a result, the reversible thermosensitive recording layer looks milky white.

Figure 1:
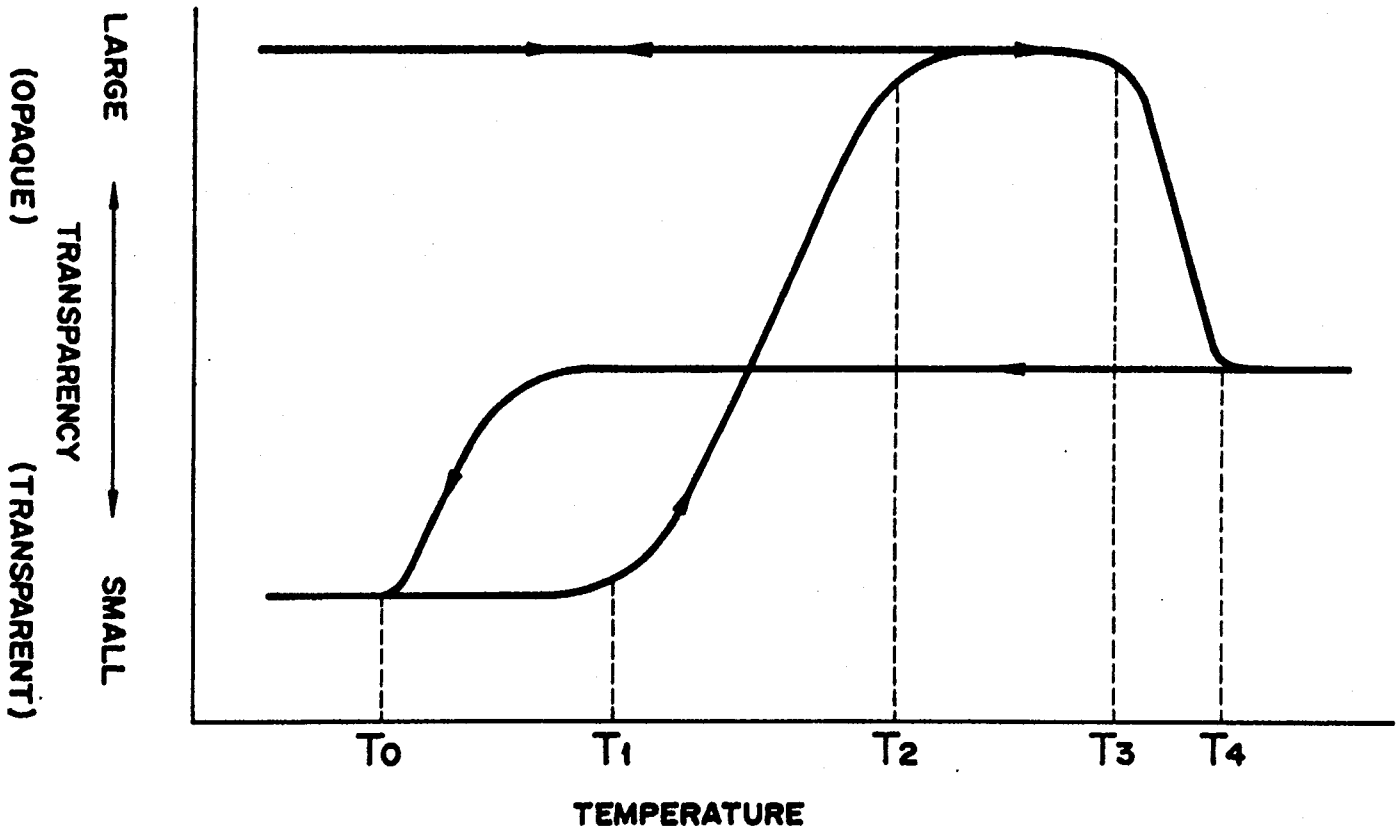
FIG. 1 is a diagram showing the changes in the transparency of the reversible thermosensitive recording layer of the reversible thermosensitive recording medium of the present invention.

FIG. 1 is a diagram showing the changes in the transparency of the reversible thermosensitive recording layer (hereinafter referred to as the recording layer) which comprises as the main components the matrix resin and the particles of the organic low-molecular-weight material which are dispersed in the matrix resin.

It is supposed that the recording layer is in a milky white opaque state at temperature $T_0$ which is room temperature or below room temperature.

When the temperature of the recording layer is raised by the application of heat thereto, the recording layer gradually begins to become transparent at temperature $T_1$. The recording layer becomes transparent when heated to a temperature in the range of $T_2$ to $T_3$. Even when the temperature of the recording layer in such a transparent state is decreased back to room temperature, the transparent state is maintained. This is because when the temperature of the recording layer reaches a temperature near $T_1$, the matrix resin begins to be softened and is shrunk, so that the gaps at the interface between the matrix resin and the particles of the organic low-molecular-weight material, and the gaps within the particles of the low-molecular-weight material are decreased. As a result, the transparency of the recording layer is gradually increased. When the temperature of the recording layer reaches $T_2$ to $T_3$, the organic low-molecular-weight material is in a half-melted state, so that the remaining gaps are filled with the organic low-molecular-weight material. As a result, the recording layer becomes transparent. The recording layer in such a transparent state, however, still contains seed crystals of the organic low-molecular-weight material, so that when the recording layer in such a transparent state is cooled, the organic low-molecular-weight material is crystallized while it is still at a relatively high temperature, and the matrix resin is in a softened state at the relatively high temperature. When the recording layer is further cooled, the changes in the volume of the matrix resin follow the changes in the volume of the organic low-molecular-weight material caused by the crystallization, without forming the gaps therebetween, so that the transparent state is maintained. The temperature at this crystallization is referred to as the higher crystallization temperature ($T_{B1}$).

When the recording layer at a temperature in the range of $T_2$ to $T_3$ is further heated to temperature $T_4$ or a temperature above $T_4$, the recording layer assumes a semi-transparent state with a transparency between the maximum transparent state of the recording layer and the maximum opaque state thereof.

When the temperature of the recording layer in such a semi-transparent state is decreased, the recording layer assumes the initial milky white state again, without assuming any transparent state during the cooling process.

This is because the organic low-molecular weight material is completely melted when heated to temperature $T_4$ or a temperature above $T_4$, and when the temperature of the melted organic low-molecular-weight material is decreased, the organic low-molecular-weight material is supercooled and crystallized at a temperature slightly higher than temperature $T_0$. It is considered that, in this case, the matrix resin cannot follow up the changes in the volumes of the organic low-molecular-weight material caused by the crystallization thereof, so that gaps are formed between the matrix resin and the organic low-molecular-weight material, and the recording layer assumes the initial milky white state. The temperature at which the above-mentioned crystallization takes place is referred to as a lower crystallization temperature $T_{B2}$.

The temperature-transparency changes curves shown in FIG. 1 are representative examples and therefore such curves may be different from the curves shown in FIG. 1, depending upon the materials employed in the recording layer.

The phenomenon that the crystallization temperature of the organic low-molecular-weight material is changed when heat application temperature is changed takes place only when the organic low-molecular-weight material is in the state of particles and enclosed within the matrix resin.

The transparent-milky white state changes are determined in accordance with the balance among the higher crystallization temperature ($T_{B1}$) and the lower crystallization temperature ($T_{B2}$) of the organic low-molecular-weight material and the softening initiation temperature of the matrix resin.

The larger the difference between the higher crystallization temperature ($T_{B1}$) and the lower crystallization temperature ($T_{B2}$), the more improved the image contrast. Thus, it is preferable that the difference be 40° C. or more, more preferably 50° C. or more, furthermore preferably 60° C. or more.

The higher crystallization temperature ($T_{B1}$) is usually equal to or immediately below the melting point of the organic low-molecular-weight material and the recording layer changes from the milky white state to the transparent state by the melting of the organic low-molecular-weight material. Therefore, the higher the higher crystallization temperature ($T_{B1}$), the more improved the heat resistance of the formed images.

It is preferable that the higher crystallization temperature ($T_{B1}$) be 80° C. or more, more preferably 90° C. or more, furthermore preferably 100° C. or more.

As mentioned previously, in order to adequately produce the transparent-milky white changes in the reversible thermosensitive recording medium of the present invention, it is required that the reversible thermosensitive recording layer have a softening initiation temperature ($T_A$) which is between the higher crystallization temperature ($T_{B1}$) and the lower crystallization temperature ($T_{B2}$) of the organic low-molecular-weight material.

When the difference between the higher crystallization temperature ($T_{B1}$) of the organic low-molecular-weight material and the softening initiation temperature ($T_A$) of the recording layer is extremely small, the degree of the softening of the matrix resin at the higher crystallization temperature ($T_{B1}$) is insufficient, so that it is difficult for the matrix resin become to follow up the changes in the volume of the organic low-molecular-weight material. As a result, the transparency of the recording layer is lowered and the image contrast is also lowered.

Therefore it is preferable that the difference between the higher crystallization temperature ($T_{B1}$) of the organic low-molecular-weight material and the softening initiation temperature ($T_A$) of the recording layer be 10° C. or more, more preferably 20° C. or more.

On the other hand, when the difference between the softening initiation temperature ($T_A$) of the recording layer and the lower crystallization temperature ($T_{B2}$) of the organic low-molecular-weight material is too small, the matrix resin is in a slightly softened state at the lower crystallization temperature ($T_{B2}$), so that when the volume of each particle of the organic low-molecular-weight material is changed at the crystallization thereof, the volume of the matrix resin is also changed so as to follow up the changes of the volume of the organic low-molecular-weight material. As a result, the degree of the formation of the gaps between the matrix resin and the organic low-molecular-weight material is lowered and accordingly the milky white degree and image contrast are lowered.

Therefore, it is preferable that the difference between the softening initiation temperature ($T_A$) of the recording layer and the lower crystallization temperature ($T_{B2}$) of the organic low-molecular-weight material be 10° C. or more, more preferably 20° C. or more.

As mentioned previously, the recording layer begins to change from a milky white state to a transparent state at the softening initiation temperature ($T_A$). Therefore, it is preferable that the softening initiation temperature ($T_A$) be high in order to improve the heat resistance of formed images. More specifically, it is preferable that the softening initiation temperature ($T_A$) be 80° C. or more, more preferably 90° C. or more, furthermore preferably 100° C. or more.

When the lower crystallization temperature ($T_{B2}$) of the organic low-molecular-weight material is lower than the ambient temperature at which this reversible thermosensitive recording medium is used in practice, the organic low-molecular-weight material cannot be completely crystallized, so that even when the milky white state of the recording layer cannot be changed to the transparent state even when the recording layer is heated.

In order to avoid this problem, it is preferable that the lower crystallization temperature ($T_{B2}$) of the organic low-molecular-weight material be 35° C. or more, more preferably 40° C. or more, furthermore preferably 50° C. or more.

The above-mentioned crystallization temperatures ($T_{B1}$) and ($T_{B2}$) can be measured by paring part of the recording layer, for instance, by use of a knife to obtain a test sample and subjecting the test sample to the measurement by use of a differential scanning calorimeter (DSC). In this case, there are no problems even if the test sample contains part of a protective layer or of the support material for the recording layer.

More specifically, the measurement is carried out as follows:

The temperature of the test sample is elevated to a temperature at which the organic low-molecular-weight material in the test sample is completely melted, whereby the temperature range in which the organic low-molecular-weight material is melted is determined for confirmation.

The test sample is then cooled. Thereafter, the heating and cooling process is repeated near the above-mentioned melting temperature range for the organic low-molecular-weight material, with a maximum heat application temperature for heating the test sample being varied.

In the case where the organic low-molecular-weight material is composed of a single component with high purity, it is preferable that the above-mentioned heating and cooling process be repeated with the maximum heat application temperature being changed stepwise with a unit of about 0.5° C.

However, in the case where the purity of the organic low-molecular-weight material is low, or the organic low-molecular-weight material is composed of a plurality of compounds with different melting points, the maximum heat application temperature may be changed with a slightly larger unit when the above-mentioned measurement is performed.

The above-mentioned crystallization temperatures can be measured when the test sample is cooled during the course of the measurement by use of DSC. When the maximum heat application temperature is varied, at least two, and occasionally three or four crystallization exothermic peaks can be detected during the DSC measurement. Of these crystallization exothermic peaks, the peak temperature of the highest temperature crystallization peak is determined as the higher crystallization temperature ($T_{B1}$), and the peak, temperature of the lowest temperature crystallization peak is determined as the lower crystallization temperature ($T_{B2}$).

In the case where the crystallization exothermic peak is too broad to determine the peak temperature, the center temperature of the peak is determined as the crystallization temperature.

The softening initiation temperature ($T_A$) of the recording layer can be measured by a rigid-body pendulum type viscoelastic properties measuring instrument.

In the measurement by use of such a measuring instrument, a cylindrical or knife-edge shaped pendulum is placed on the recording layer, and the pendulum is caused to be vibrated. From the logarithmic attenuation of the vibration of the pendulum, the viscoelastic properties of the recording layer are measured.

This method is characterized in that the measurement of the viscoelastic properties of the recording layer can be performed even if a support material is provided on the back side of the recording layer or other layers are provided on the recording layer.

However, when the physical properties of the recording layer itself are measured, it is required that, for instance, the physical properties of the reversible thermosensitive recording medium be first measured, and then layers overlaid on the recording layer, such as a protective layer, be removed by scraping and the physical properties of the exposed recording layer be measured once again.

Furthermore, when it is desired to determine the physical properties of the recording layer by eliminating adverse effects of layers which are disposed under the recording layer, such as a support material, on the measurement of the physical properties of the recording layer, the physical properties of the support are measured by paring the recording layer, and the data thereof is compared with the above measured physical properties of the recording layer, whereby the physical properties of the recording layer itself are determined.

As a commercially available rigid-body pendulum type viscoelastic properties measuring instrument, for instance, "Rheovibron DDV-OPA III" (Trademark) made by Orientec Company, Ltd. can be employed.

Figures 2A, 2B, 2C:
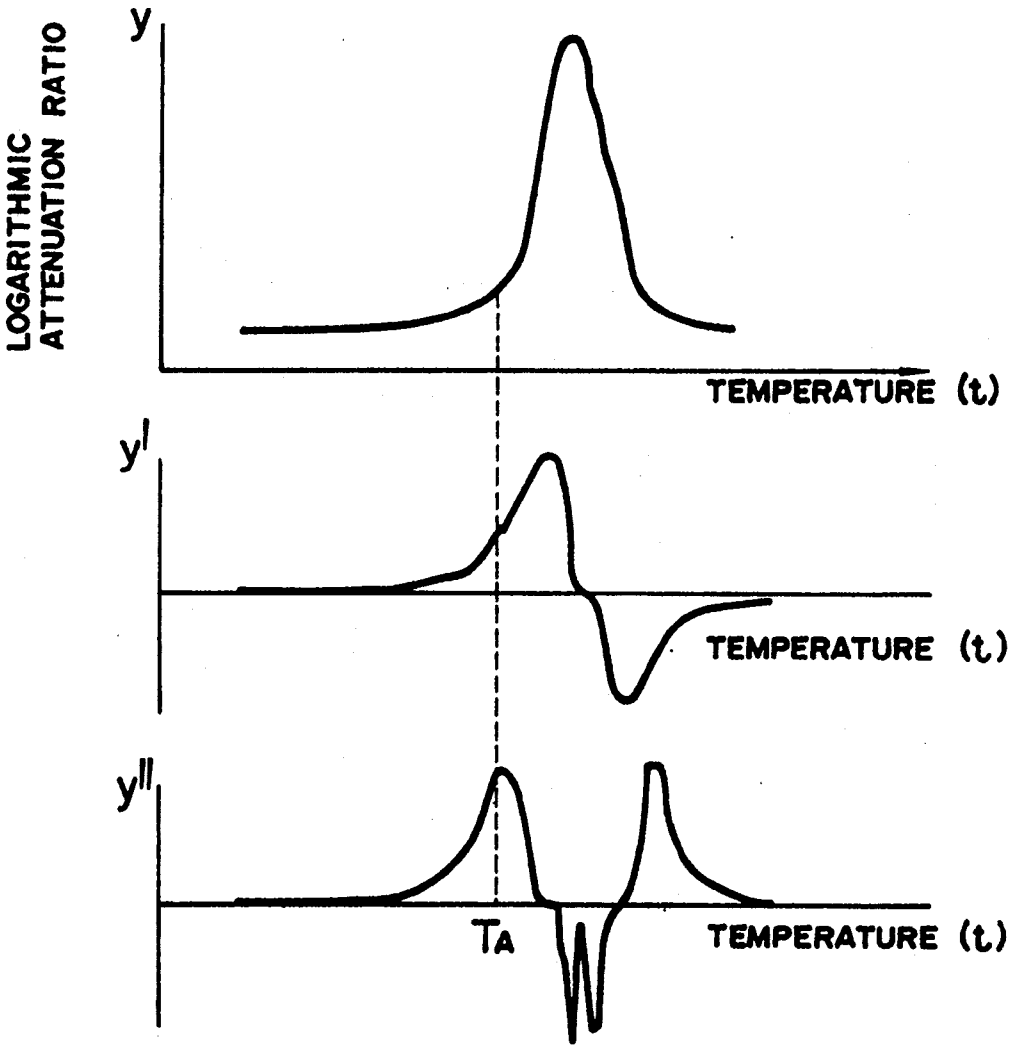
FIGS. 2(*a*) to 2(*c*) show a method of determining the softening initiation temperature ($T_A$) of the reversible thermosensitive recording layer of the reversible thermosensitive recording medium of the present invention.

An example of the above measurement by use of the commercially available rigid-body pendulum type viscoelastic properties measuring instrument is shown in FIGS. 2(*a*) to 2(*c*). In the graph shown in FIG. 2(*a*), the logarithmic attenuation (y) is plotted as ordinate and the temperature (t) as abscissa. FIG. 2(*b*) shows the curve (y') obtained by differentiating the curve (y) in FIG. 2(*a*) with respect to the temperature (t). FIG. 2(*c*) shows the curve (y'') obtained by differentiating the curve (y') in FIG. 2(*b*) with respect to the temperature (t). The softening initiation temperature ($T_A$) is defined as the temperature in the first peak shown in FIG. 2(*c*).

A thermal pressure level difference in the reversible thermosensitive recording medium of the present invention is defined as follows:

The thermal pressure level difference is a physical value indicating the hardness of a coated film when heated. The smaller the value, the harder the coated film. When the value of the thermal pressure level difference of the recording layer is 40% or less, the advantages of the present invention over the conventional reversible thermo-sensitive recording media, particularly the durability at the time of repeated image formation and erasure, for instance, by use of a thermal head, can be effectively obtained. It is considered that this is because when the value of the thermal pressure level difference is 40% or less, the force for restraining the particles of an organic low-molecular-weight compound from aggregating and becoming large, which may be otherwise caused by the mutual contact of the particles, is significantly increased, so that the deformation of the recording layer is minimized even though heat and pressure are applied thereto, for instance, by a thermal head.

Figure 3A:
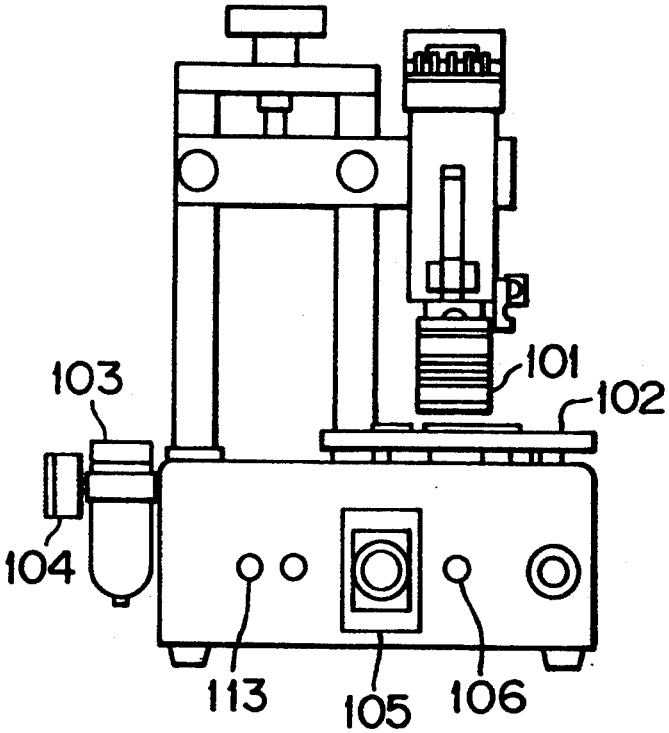
FIG. 3(*a*) is a front view of a thermal pressure application apparatus for the measurement of the thermal pressure level difference of a display portion in a reversible thermosensitive recording medium of the present invention.
Figure 3B:
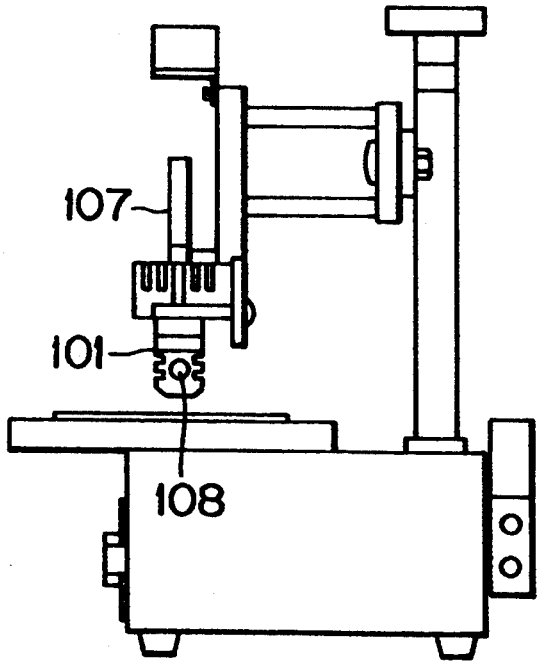

As a thermal pressure application apparatus for the measurement of the thermal pressure level difference, a desk-top hot-stamp air type TC film erasure test machine made by Unique Machinery Company, Ltd. as shown in FIGS. 3(*a*)and 3(*b*) is employed.

FIG. 3(*a*) is a schematic front view of the thermal pressure application apparatus, and FIG. 3(*b*) is a schematic side view of the thermal pressure application apparatus.

As shown in FIG. 3(*a*) and FIG. 3(*b*), the thermal pressure application apparatus comprises an air regulator 103 for pressure adjustment, a printing timer 105 for time adjustment, a temperature regulator (not shown) for temperature adjustment, a printing head 101 for thermal pressure printing, and a sample support 102 for supporting a test sample thereon.

Figure 4:
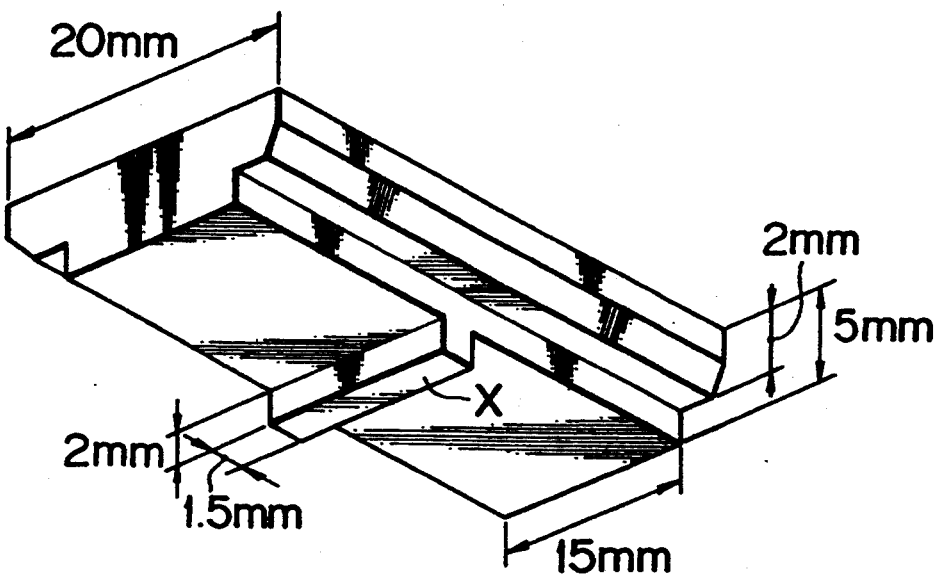
FIG. 4 is a perspective view of a thermal head for use in the present invention.

The printing head 101 is a printing head which is modified for the measurement of the thermal pressure level difference of a test sample of a reversible thermosensitive recording medium, more specifically a printing head shown in FIG. 4.

As the material for the printing head 101, aluminum is employed. It is preferable that the surface roughness (Ry) of the projected portion X of the printing head 101 which comes into contact with the surface of the reversible thermosensitive recording layer be 0.8 μm or less in accordance with Japanese Industrial Standards (JIS) B0031-1982 and B0601-1994 as shown in FIG. 4. The cross-section area of the projected portion X, which comes into contact with the reversible thermosensitive recording layer is 0.225 $cm^2$.

Figure 5:
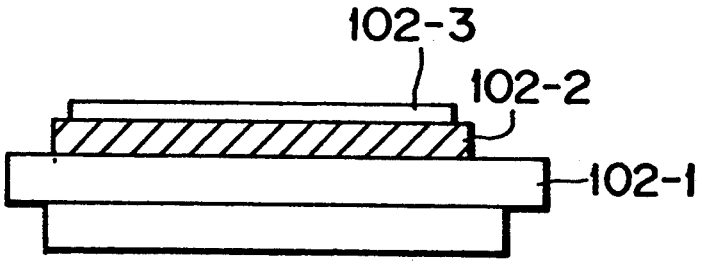
FIG. 5 is a schematic cross-sectional view of a composite plate composed of an aluminum plate, a fluorine rubber layer on the aluminum plate, and a stainless steel plate formed on the fluorine rubber for placing a sample of a reversible thermosensitive recording medium to be tested.

On the sample support 102 shown in FIG. 3(*a*), there is provided a composite plate composed of an aluminum plate 102-1, a fluorine rubber layer 102-2 with a thickness of 1 mm and with a hardness of Hs65 in terms of spring hardness, provided on the aluminum plate 102-1, and a stainless steel plate 102-3 with a thickness of 1 mm provided on the fluorine rubber layer 102-2 as shown in FIG. 5, in order to prevent the pressure applied at thermal pressure application from being dispersed.

The conditions for the measurement of the thermal pressure level difference of the test sample by use of the thermal pressure application apparatus as shown in FIG. 3(*a*) and FIG. 3(*b*) are as follows:

The air regulator 103 shown in FIG. 3(*a*) is adjusted to obtain such a printing pressure that the air gauge pressure value in an air gauge 104 shown in FIG. 3(*a*) is 2.5 $kg/cm^2$. The printing timer 105 shown in FIG. 3(*a*) is then adjusted in such a manner that the printing time is set at 10 seconds. Furthermore, the temperature regulator is adjusted in such a manner that the printing temperature is set at 140° C.

The printing temperature mentioned here is the temperature adjusted by a heater & temperature sensor 108 shown in FIG. 3(*b*), and is approximately the same as the temperature of the surface of the printing head 101.

A method of measuring the value of the thermal pressure level difference of a test sample to which a thermal pressure is applied by the above-mentioned thermal pressure application apparatus will now be explained.

As the measurement apparatus, a two-dimensional roughness analyzer (Trademark "Surfcorder AY-41" made by Kosaka Laboratory Co., Ltd.), a recorder RA-60E, and Surfcorder SE30K are employed.

The measurement conditions for Surfcorder SE30K are set, for example, in such a manner that the vertical magnification (V) is 2,000, and the horizontal magnification (H) is 20.

The measurement conditions for Surfcoder AY-41 are set, for example, in such a manner that the standard length (L) is 5 mm, and the stylus scanning speed (Ds) is 0.1 mm/sec. The measured results are recorded in charts by use of the recorder RA-60E. The value of the thermal pressure level difference (Dx) in the thermal pressure applied portion is read from the charts in which the measured results are recorded.

The above-mentioned measurement conditions are exemplary and can be changed as desired when necessary.

Figure 6:
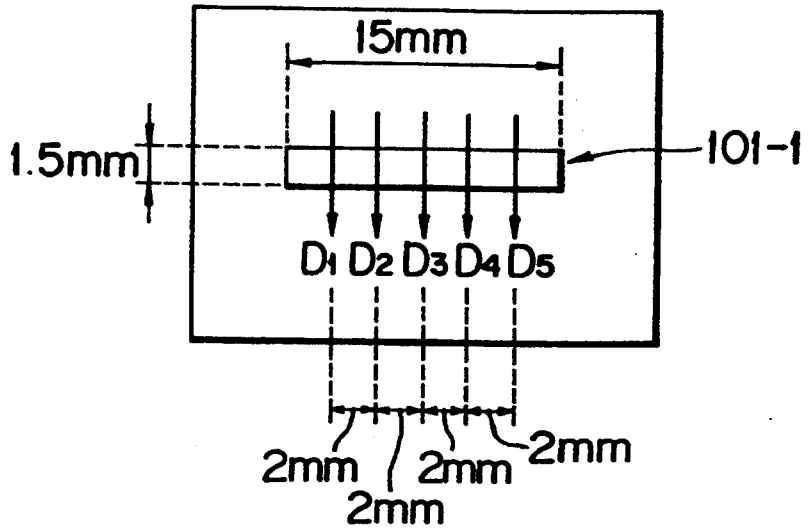
FIG. 6 is a schematic illustration of the portion of a sample for the measurement of the value of the thermal pressure level difference (Dx) thereof.

The measurement of the value of the thermal pressure level difference (Dx) is measured at 5 points, $D_1$ to $D_5$, with intervals of 2 mm therebetween in the width direction of the thermal pressure applied portion, as illustrated in FIG. 6.

The average value is obtained as the average thermal pressure level difference (Dm), and the thermal pressure level difference (D) can be obtained from the average thermal pressure level difference (Dm) and the thickness ($D_B$) of the reversible thermosensitive recording layer in accordance with the following formula:

$$D\,(\%) = \frac{Dm}{D_B} \times 100$$

wherein D is the thermal pressure level difference (%), Dm is the average thermal pressure level difference (μm), and $D_B$ is the thickness (μm) of the reversible thermosensitive recording layer.

The above-mentioned thickness ($D_B$) is the thickness of the reversible thermosensitive recording layer formed on the support and can be measured by inspecting the cross section of the reversible thermosensitive recording layer by a transmission electron microscope (TEM) or a scanning electron microscope (SEM).

A thermal pressure level difference change ratio of a coated layer is the degree of the change with time in the hardness of the coated layer when the coated layer is heated. The smaller the value of the thermal pressure level difference change ratio, the stabler the coated layer.

In the case of the recording layer of the reversible thermosensitive recording medium of the present invention, when the thermal pressure level difference change ratio of the recording layer is 70% or less, the effects of the present invention become conspicuous, in particular, the stability with respect to the range and width of the transparency temperature of the recording the thermal properties of the recording layer of the reversible thermosensitive recording medium of the present invention are particularly improved in the above-mentioned critical range of the thermal pressure level difference change ratio of the recording layer.

The thermal pressure level difference change ratio can be determined in accordance with the following formula:

$$D_c\,(\%) = \left|\frac{D_I - D_D}{D_I}\right| \times 100$$

wherein $D_C$ is the thermal pressure level difference change ratio (%), $D_I$ is the initial thermal pressure level difference (%), and $D_D$ is the thermal pressure level difference changed with time (%).

In the above, the initial thermal pressure level difference ($D_I$) is the value of the thermal pressure level difference of a sample image display portion formed in a test sample, measured for the first time after the formation of the sample image display portion. This is not necessarily the value measured immediately after the preparation of the sample image display portion.

The thermal pressure level difference changed with time ($D_D$) is the value of the thermal pressure level difference of a sample image display portion which is prepared at the same time as that of the preparation of the sample image display portion for the measurement of the initial thermal pressure level difference ($D_I$) thereof and is then allowed to stand at 50° C. for 24 hours.

These values of the thermal pressure level difference are measured by the previously mentioned measurement method and then calculated in the same manner as mentioned previously.

In case these thermal pressure level differences cannot be measured under the same conditions (2.5 kg/cm$^2$, 140° C.) as mentioned previously, the pressure and temperature may be changed appropriately.

The measurement method for the thermal pressure level difference can be applied not only to the previously mentioned reversible thermosensitive recording medium including only the reversible thermosensitive recording layer, but also to the reversible thermosensitive recording medium including both the reversible thermosensitive recording layer and a protective layer therefor.

The reversible thermosensitive recording medium may be fabricated with such a layer structure that a thermosensitive recording layer and a magnetic recording layer comprising as the main component a magnetic material are provided on a support, and at least a lower portion of the thermosensitive recording layer or a portion of the support immediately below the thermosensitive recording layer is colored as disclosed in Japanese Utility Model Application 2-3876.

Furthermore, such a layer structure as disclosed in Japanese Laid-Open Patent Application 3-130188 that a magnetic recording layer, a light reflection layer, and a thermosensitive recording layer are successively overlaid on a support may also be applicable. In this case, the magnetic recording layer may be provided on the back side of the support opposite to the thermosensitive recording layer, or between the support and the thermosensitive recording layer. Other layer structures may also be employed.

The above-mentioned measurement of the thermal pressure level difference is applicable without any problems to the reversible thermosensitive recording media with any of the above-mentioned structures by performing thermal pressure printing on the surface of the thermosensitive recording layer.

In the case where a protective layer is provided on the reversible thermosensitive recording layer which is formed on the support, it is necessary to expose the reversible thermosensitive recording layer by eliminating the protective layer therefrom for the measurement of the thermal pressure level difference. In this case, the thickness of the reversible thermosensitive recording layer and the thickness of the protective layer are measured by the cross section inspection thereof by using TEM or SEM, and the protective layer is then scraped off.

Figure 7:
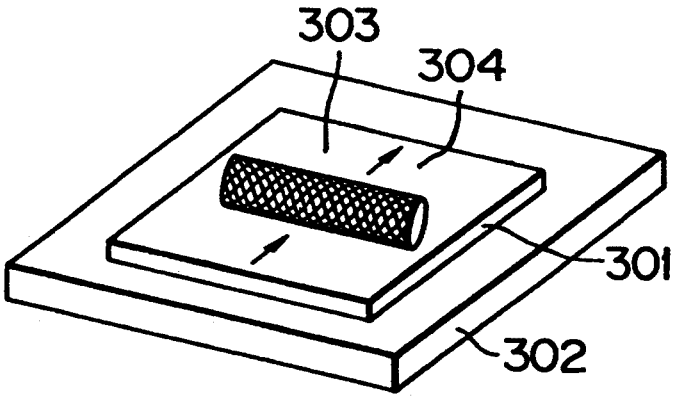
FIG. 7 is a schematic illustration of a method for scraping a protective layer of a reversible thermosensitive recording layer.
Figure 8A:
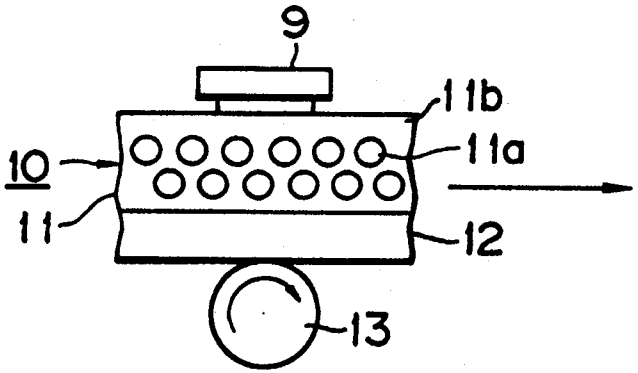
FIGS. 8(*a*) to 8(*d*) schematically show the changes of the state of the particles of an organic low-molecular-weight material which are dispersed within the reversible thermosensitive recording layer of a reversible thermosensitive recording medium in the course of image formation thereon by a thermal head.
Figure 8B:
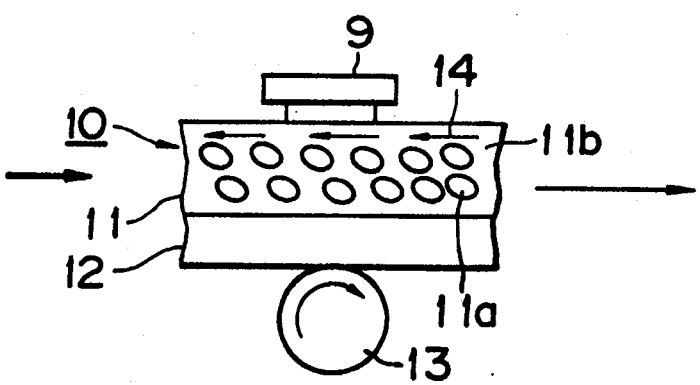
Figure 8C:
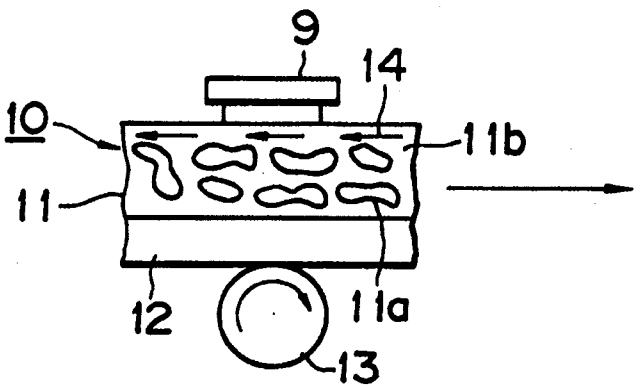
Figure 8D:
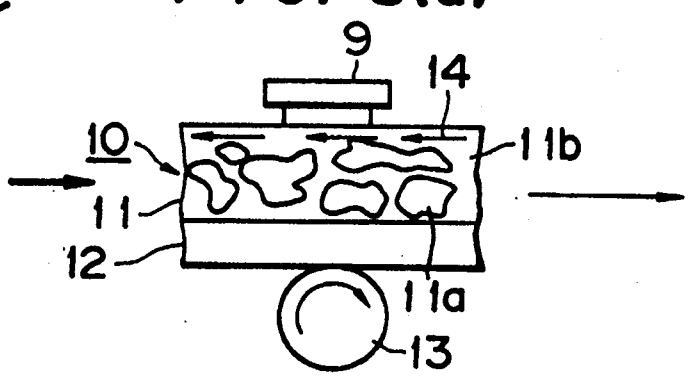

The protective layer can be scraped off the reversible thermosensitive recording layer by the method as illustrated in FIG. 7.

The above-mentioned reversible thermosensitive recording medium 301 is fixed on stainless steel plate support 302 with a thickness of 2 mm in such a posture that the protective layer thereof is situated on the top surface of the recording medium 301 as illustrated in FIG. 7.

A surface cutting member 303 which is composed of (a) a brass cylinder with a diameter of 3.5 cm and (b) a sand-paper (roughness No. 800) with which the brass cylinder is wrapped is moved, without being rotated, in the direction of the arrow in contact with the protective layer. The pressure to be applied in the vertical direction with respect to the surface of the protective layer is in the range of 1.0 to 1.5 kg/cm$^2$. The number of the repetition of the movement of the surface cutting member 303 along the protective layer is determined in accordance with the thickness of the protective layer to be scraped off the reversible thermosensitive recording layer. The thickness of the protective layer is measured prior to the scraping operation by an electronic micrometer (film thickness meter).

Even if the surface of the exposed reversible thermosensitive recording layer is roughened after the protective layer is scraped off the reversible thermosensitive recording layer, the thermal pressure level difference thereof can be properly measured without being effected by the surface roughness thereof.

In the case where an intermediate layer is interposed between the protective layer and the reversible thermosensitive recording layer, and also in the case where a printed layer is provided on the protective layer, and even in the case where a heat resistant film is applied to the reversible thermosensitive recording layer, the above-mentioned method for measuring the thermal pressure level difference can be employed by exposing the surface of the reversible thermosensitive recording layer in the same manner as mentioned above.

A gel percentage change ratio of a resin employed in the reversible thermosensitive recording layer of the reversible thermosensitive recording medium of the present invention is a physical property indicating the change ratio of the crosslinking degree of the resin with time. The smaller the value of the gel percentage change ratio, the stabler the cross-linking degree of the resin in the reversible thermosensitive recording layer.

When the value of the gel percentage change ratio is 110% or less, the hardness of the coated film and the stability of the thermal physical properties of the coated film are significantly improved, so that it is considered that various properties of the reversible thermosensitive recording medium, such as repeated use durability and transparent temperature range, are significantly stabilized.

The gel percentage change ratio can be determined in accordance with the following formula:

$$G_c\,(\%) = \left|\frac{G_I - G_D}{G_I}\right| \times 100$$

wherein $G_C$ is the gel percentage change ratio (%), $G_I$ is the initial gel percentage (%), and $G_D$ is the gel percentage changed with time (%).

In the above, the initial gel percentage ($G_I$) is the value of the gel percentage of a sample recording layer measured for the first time after the cross-linking of the sample recording layer. This may not be necessarily the value measured immediately after the crosslinking.

The gel percentage changed with time ($G_D$) is the value of the gel percentage changed with time of a sample recording layer which is crosslinked at the same time as that of the crosslinking of the sample recording layer for the measurement of the initial gel percentage ($G_I$) thereof and is then allowed to stand at 50° C. for 24 hours.

In the reversible thermosensitive recording medium of the present invention, it is preferable that the initial gel percentage (%) be 30% or more, more preferably 50% or more, furthermore preferably 70% or more, most preferably 80% or more in view of the improvement of the durability of formed images and the heat resistance of the recording medium with the application of excess energy thereto.

The gel percentage can be measured as follows:

A reversible thermosensitive recording layer with an appropriate thickness is formed on a support, and the crosslinking of the recording layer is then performed by electron beam irradiation. The crosslinked recording layer is then peeled off the support, and the initial weight of the crosslinked recording layer is measured.

The crosslinked recording layer is held between a pair of 400-mesh wire nets and immersed into a solvent in which the resin prior to the above crosslinking for the recording layer is soluble and is maintained therein for 24 hours.

The crosslinked recording layer is then dried in vacuum, and the weight of the dried crosslinked recording layer is measured.

The gel percentage is calculated in accordance with the following formula:

$$\text{Gel Percentage (\%)} = [\text{Weight after Drying (g)}/\text{Initial Weight (g)}] \times 100$$

When the gel percentage is calculated in accordance with the above formula, if, for example, the organic low-molecular-weight material other than the resin component is contained in the recording layer, it is necessary to remove the weight of the organic low-molecular-weight material so that the gel percentage is calculated in accordance with the following formula:

$$\text{Gel Percentage (\%)} = \frac{\text{Weight after Drying (g)}}{\text{Initial Weight (g)} - \text{Weight of Organic low-molecular material (g)}} \times 100$$

In the above, when the weight of the organic low-molecular-weight material is unknown when calculating the above gel percentage, a cross section of the recording layer is obtained by a transmission electron microscope (TEM) or a scanning electron microscope (SEM) and the ratio of the area of the organic low-molecular-weight material to the area of the resin per unit area of the cross section of the recording layer is determined, and then the ratio of the weight of the organic low-molecular-weight material to that of the resin is then calculated from the respective specific densities of the organic low-molecular-weight material and the resin. For this calculation, the weight of the organic low-molecular-weight material is obtained, whereby the above gel percentage is calculated.

Furthermore, in the case of a reversible thermosensitive recording medium comprising a support, a reversible thermosensitive recording layer formed thereon, and other layers overlaid on the reversible thermosensitive recording layer, or in the case where the previously mentioned layer is interposed between the support and the reversible thermosensitive recording layer, the thickness of each of these layers is measured by the cross-sectional observation of those layers by TEM or SEM, and the surface of the reversible thermosensitive recording layer is exposed by scraping other layers off the reversible thermosensitive recording layer by the previously mentioned method, and the reversible thermosensitive recording layer is peeled off, so that the gel percentage of the reversible thermosensitive recording layer is measured by the above-mentioned method.

In the above, when there is provided a protective layer comprising, for example, a UV resin, on the reversible thermosensitive recording layer, it is necessary to scrape such a protective layer off the reversible thermosensitive recording layer, and also to scrape the surface portion of the reversible thermosensitive recording layer slightly in order to minimize the contamination of the reversible thermosensitive recording layer with the resin component of the protective layer, whereby the gel percentage of the reversible thermosensitive recording layer can be accurately measured by preventing adverse effects of the resin component from the protective layer on the measurement of the gel percentage.

In addition to the above, there are the following three methods of measuring the gel percentage:

In the first method, a crosslinked hardened resin film is extracted with a solvent in which the uncrosslinked resin component is soluble, for instance, for 4 hours, by use of a Soxhlet extractor, to remove the uncrosslinked resin component from the crosslinked hardened resin film, whereby the weight percentage of the unextracted residue is obtained.

In the second method, a recording film layer is formed by coating on a surface-treated PET support. The thus formed recording film layer is then subjected to electron beam (BE) radiation and immersed in a solvent. Thus, the ratio of the thickness of the recording film layer before the immersion to the thickness of the recording film layer after the immersion is obtained.

In the third method, a recording film layer is formed in the same manner as in the above second method, and 0.2 ml of a solvent is dropped on the surface of the recording film layer, then allowed to stand for 10 seconds, and wiped off the surface of the recording film layer, whereby the ratio of the thickness of the recording film layer before the dropping of the solvent to the thickness of the recording film layer after the dropping of the solvent is obtained.

In the above-mentioned first method, the gel percentage calculation is performed by eliminating the weight of the organic low-molecular-weight material from the initial weight of the recording film layer as mentioned previously.

In contrast to this, in the above-mentioned second and third methods, the thickness of the recording film layer is measured. Therefore, if the matrix resin which surrounds the organic low-molecular-weight material is completely crosslinked, it is considered that the thickness of the recording film layer is not changed by immersing the recording layer into the solvent, so that it is unnecessary to take the presence of the organic low-molecular-weight material into consideration in the second and third methods, unlike the first method.

Furthermore, in the case where other layers are overlaid on the reversible thermosensitive recording layer, the above-mentioned first method can be applied as it is, while when the above-mentioned second and third methods are employed, it is necessary to scrape only the overlaid layers off the reversible thermosensitive recording layer.

The inventors of the present invention have investigated the mechanism as to why the image density and contrast are lowered during the repeated image formation and image erasure in a conventional reversible thermosensitive recording medium.

More specifically, when a thermal head or a heating element of a printer for a thermal destructive type thermosensitive recording medium is brought into pressure contact with the surface of the above-mentioned conventional reversible thermosensitive recording medium, the following phenomenon is observed, which will be explained with reference to FIGS. 8(*a*) and FIG. 8(*b*). In FIGS. 8(*a*) and 8(*b*), reference numeral 9 indicates a thermal head; reference numeral 10 indicates a conventional reversible thermosensitive recording medium, which comprises a reversible thermosensitive recording layer 11 comprising the particles of an organic low-molecular-weight material 11*a* which are dispersed in a matrix resin 11*b*, and a support 12 made of, for instance, a PET film, for supporting the reversible thermosensitive recording layer 11 thereon; and reference numeral 13 indicates a platen roller which is rotated in the direction of the arrow in contact with the support 12.

Before the application of thermal energy to the reversible thermosensitive recording medium 10 comprising the reversible thermosensitive recording layer 11 in which the particles of the organic low-molecular-weight material 11*a* are dispersed in the matrix resin 11*b*, or when the number of the application of thermal energy thereto for the image formation or image erasure is a few, such a distortion of the reversible thermosensitive recording layer 11 that changes the state of the presence of the components that constitute the recording layer 11 is so slight that the particles of the organic low-molecular-weight material 11a are uniformly dispersed within the recording layer 11 as illustrated in FIG. 8(*a*).

As will be explained later, the distribution of the particles of the organic low-molecular-weight material can be maintained uniform in the reversible thermosensitive recording layer of the reversible thermosensitive recording medium of the present invention even though image formation and image erasure are repeated.

In the above-mentioned conventional reversible thermosensitive recording medium 10, however, when image formation means such as the thermal head 9 is moved relative to the reversible thermosensitive recording medium 10 in pressure contact with the surface thereof, stress is applied to the inside of the recording layer 11, so that while the energy application in the same direction is repeated, the distortion as illustrated in FIG. 8(*b*) is formed mainly because of the application of the above-mentioned stress. As a result, the particles of the organic low-molecular-weight material 11a are deformed as illustrated in FIG. 8(*c*). With further repetition of the application of the energy in the same direction, the above-mentioned distortion is further developed, so that the deformed particle of the organic low-molecular-weight material 11a begin to aggregate as illustrated in FIG. 8(*d*). Finally, the aggregated particles are further caused to aggregate to form aggregated particles with a maximum particle size. When the organic low-molecular-weight material 11*a* is in such a state, it is almost impossible to perform image formation in the reversible thermosensitive recording medium 10. This is a so-called deterioration state. It is considered that such a state brings about the lowering of image density when the reversible thermosensitive recording medium 10 is used repeated for image formation and image erasure.

As mentioned previously, the inventors of the present invention have discovered that the object of the present invention, that is, the provision of a reversible thermosensitive recording medium which is improved with respect to the stability of the transparent temperature range with time and the repeated use durability thereof, can be achieved by use of the reversible thermosensitive recording layer having a thermal pressure level difference of 40% or less.

In the reversible thermosensitive recording medium of the present invention, since the thermal pressure level difference of the reversible thermosensitive recording layer is 40% or less, which is much smaller than that of the reversible thermosensitive recording layer, the repeated use durability of the recording medium is particularly improved. It is considered that this is because the heat resistance and mechanical strength of the reversible thermosensitive recording layer are significantly improved.

Furthermore, when the particles of the organic low-molecular-weight material are contained in the reversible thermosensitive recording layer, the aggregation of the particles of the organic low-molecular-weight material and the maximizing the particle size thereof are difficult to take place and therefore the deterioration of the reversible thermosensitive recording layer after repeated image formation and image erasure can be minimized and high contrast can be obtained for an extended period of time.

For obtaining the above-mentioned effect, it is preferable that the thermal pressure level difference be 40% or less, more preferably 30% or less, furthermore preferably 25% or less, and most preferably 20%.

When the change ratio of the thermal pressure level difference of the reversible thermosensitive recording layer is 70% or less, it is effective for preventing the transparent temperature range from decreasing while in use. It is considered that this is because in the present invention, there are substantially no changes in the physical properties of the reversible thermosensitive recording layer with time, so that the transparent temperature range of the reversible thermosensitive recording layer is not varied, and the width of the transparent temperature range is not decreased, whereby the image erasure characteristics of the reversible thermosensitive recording layer are stabilized.

For obtaining the above-mentioned effect, it is preferable that the thermal pressure level difference change ratio of the reversible thermosensitive recording layer be 70% or less, more preferably 50% or less, furthermore preferably 45% or less, most preferably 40% or less.

In order to obtain the above-mentioned thermal pressure level difference change ratio of 70% or less, it is necessary that the matrix resin employed in the reversible thermosensitive recording layer maintain a certain hardness when the matrix resin is heated to high temperature. Specific preferable examples of a resin to be used as such matrix resin include a resin having high softening temperature, a resin comprising a main-chain resin component having high softening temperature and a side-chain resin component having low-temperature softening point, and a crosslinked resin.

As mentioned previously, the inventors of the present invention have further discovered that the object of the present invention can also be achieved by crosslinking the resin to be contained in the reversible thermosensitive recording layer in such a manner that the resin is caused to have a gel percentage change ratio of 110% or less.

In this case, for obtaining the above-mentioned effect, it is preferable that the gel percentage ratio be 30% or more, and it is more preferable that the resin be crosslinked by use of a cross-linking agent. It is further more preferable that the resin be crosslinked by electron beam or ultraviolet light radiation.

In the reversible thermosensitive recording medium of the present invention, the gel percentage change ratio of the resin contained in the reversible thermosensitive recording layer, when crosslinked, is so extremely small that, that is, the deterioration of the hardness of the resin with time is so small, that the previously mentioned erasure characteristics of the reversible thermosensitive recording medium of the present invention are considered to be stabilized.

For obtaining the above-mentioned effect, it is preferable that the gel percentage change ratio of the resin be 110% or less, more preferably 90% or less, furthermore preferably 70% or less, and most preferably 50% or less.

Furthermore, in the reversible thermosensitive recording medium of the present invention, it is considered that the crosslinked resin has so high a gel percentage ratio that the heat resistance and mechanical strength of the previously mentioned image display portion are further improved and therefore the repeated use durability of the image display portion is improved, and the formation of printing marks and cracks in the image display portion can be effectively prevented.

For obtaining this effect, it is preferable that the value of the gel percentage be 30% or more, more preferably 50% or more, furthermore preferably 70% or more.

The resin contained in the reversible thermosensitive recording layer can be crosslinked by the application of heat, ultraviolet light radiation and electron beam radiation. For this purpose, ultraviolet light radiation and electron beam radiation are preferable, and of these two radiation methods, electron beam radiation is more preferable.

The reasons why the crosslinking method by electron beam radiation is excellent are as follows.

The significant differences between the crosslinking of resin by electron beam radiation (hereinafter referred to as EB crosslinking) and the crosslinking of resin by ultraviolet light radiation (hereinafter referred to as UV crosslinking) are as follows:

In UV crosslinking, a photopolymerization initiator and a photosensitizer are necessary. The resins for UV crosslinking are mostly limited to resins having transparency. In contrast to this, in EB crosslinking, the concentration of radicals is so high that the crosslinking reaction proceeds rapidly, so that the polymerization is terminated instantly. Furthermore, EB radiation can provide more energy than UV radiation can so that the reversible thermosensitive recording layer can be made thicker than that for UV radiation.

Furthermore, as mentioned above, in UV crosslinking, a photopolymerization initiator and a photosensitizer are necessary, so that when the crosslinking reaction has been completed, the additives remain in the reversible thermosensitive recording layer and there may be the risk that these additives have adverse effects on the image formation performance, image erasure performance, and repeated use durability of the reversible thermosensitive recording layer.

The significant differences between EB crosslinking and thermal crosslinking are as follows:

In thermal crosslinking, a catalyst for crosslinking and a promoting agent are required. Even though the catalyst and promoting agent are employed, the speed of crosslinking reaction by thermal crosslinking is considerably slower than that of the crosslinking reaction by EB crosslinking. Furthermore, in the case of thermal crosslinking, additives such as the abovementioned catalyst and promoting agent remain in the reversible thermosensitive recording layer after the crosslinking reaction in the same manner as in UV crosslinking and therefore thermal crosslinking has the same shortcomings as UV crosslinking does. Furthermore, since the above-mentioned catalyst and promoting agent remain in the reversible thermosensitive recording layer, the crosslinking reaction may slightly proceed after the initial crosslinking so that it is possible that the recording characteristics of the reversible thermosensitive recording layer may change with time.

For the above-mentioned reasons, EB radiation is the most suitable for the crosslinking the resin in the reversible thermosensitive recording layer in the present invention.

It is preferable that the thickness of the reversible thermosensitive recording layer be in the range of 1 to 30 μm, more preferably in the range of 2 to 20 μm. When the reversible thermosensitive recording layer is excessively thick, the thermal distribution in the recording layer becomes non-uniform so that it becomes difficult to uniformly make the recording layer transparent. On the other hand, when the reversible thermosensitive recording layer is excessively thin, the milky white opaque degree thereof is decreased so that the contrast of formed images is lowered. The milky white opaque degree of the reversible thermosensitive recording layer can be increased by increasing the amount of a fatty acid to be contained as the organic low-molecular-weight material in the recording layer.

The reversible thermosensitive recording medium comprising the reversible thermosensitive recording layer of type 1 can be fabricated by providing the reversible thermosensitive recording layer on a support by the following methods. The reversible thermosensitive recording layer can be made in the form of a sheet without using the support as the case may be.

(1) A matrix resin and an organic low-molecular-weight material are dissolved in a solvent. This solution is coated on a support. The solvent of the coated solution is then evaporated to form a film-shaped layer or sheet, and the film-shaped layer or sheet is simultaneously crosslinked on the support. The crosslinking may be performed after the formation of the film-shaped layer or sheet.

(2) A matrix resin is dissolved in a solvent in which only the matrix resin is soluble. An organic low-molecular-weight material is pulverized by various methods and dispersed in the above matrix resin solution. The above dispersion is then coated on a support. The solvent of the coated dispersion is then evaporated to form a film-shaped layer or sheet, and the film-shaped layer or sheet is simultaneously crosslinked on the support. The crosslinking may be performed after the formation of the film-shaped layer or sheet.

(3) A matrix resin and an organic low-molecular-weight material are melted with the application of heat thereto without using a solvent. The thus melted mixture is formed into a film or sheet and cooled. The thus formed film or sheet is then crosslinked.

As the solvents for forming a reversible thermosensitive recording layer or a reversible thermosensitive recording medium, varieties of solvents can be employed in accordance with the kinds of the matrix resin and organic low-molecular-weight material to be employed. Specific examples of such solvents include tetrahydrofuran, methyl ethyl ketone, methyl isobutyl ketone, chloroform, carbon tetrachloride, ethanol, toluene, and benzene.

The organic low-molecular-weight material is present in a dispersed state in the form of finely-divided particles in the reversible thermosensitive recording layer not only when the reversible thermosensitive recording layer is formed by coating the above-mentioned dispersion, but also when the reversible thermosensitive recording layer is formed by coating the above-mentioned solution.

In the present invention, as the matrix resin for the reversible thermosensitive recording layer of the reversible thermosensitive recording medium, a resin that can be formed into a film layer or sheet and has excellent transparency and stable mechanical strength is preferable.

Such a resin may comprise at least one resin component selected from the group consisting of polyvinyl chloride, chlorinated polyvinyl chloride, polyvinylidene chloride, saturated polyester, polyethylene, polypropylene, polystyrene, polymethacrylate, polyamide, polyvinyl pyrrolidone, natural rubber, polyacrolein, and polycarbonate; or may be a copolymer comprising any of the above-mentioned resin components.

In addition, as the resin, polyacrylate, polyacrylamide, polysiloxane, polyvinayl alcohol, and copolymers of any of the monomers for these polymers can be employed.

Furthermore, as the above-mentioned resin, the following resins can be employed: polyvinyl chloride; vinyl chloride copolymers such as vinyl chloride-vinyl acetate copolymer, vinyl chloride-vinyl acetate-vinyl alcohol copolymer, vinyl chloride-vinyl acetate maleic acid copolymer, and vinyl chloride-acrylate copolymer; polyvinylidene chloride; vinylidene chloride copolymers such as vinylidene chloride-vinyl chloride copolymer, and vinylidene chloride-acrylonitrile copolymer; polymethacrylate; and methacrylate copolymer.

In the case where vinyl chloride copolymer is employed as the matrix resin, it is preferable that the average polymerization degree (p) be 300 or more, more preferably 600 or more, and the weight ratio of the vinyl chloride unit to a copolymerizable unit be in the range of 95/5 to 60/40, more preferably in the range of 92/8 to 65/35.

It is preferable that matrix resins for use in the reversible thermosensitive recording layer in the present invention have a glass transition temperature (Tg) of less than 100° C., more preferably less than 90° C., and most preferably less than 80° C.

It is required that the organic low-molecular-weight material for use in the present invention can be formed in the shape of particles in the reversible thermosensitive recording layer. It is preferable that the organic low-molecular-weight material have a melting point in the range of 30° to 200° C., more preferably in the range of 50° to 150° C.

Specific examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials can be used alone or in combination.

It is preferable that the number of carbon atoms of the above-mentioned organic low-molecular-weight material be in the range of 10 to 60, more preferably in the range of 10 to 38, furthermore preferably in the range of 10 to 30. Part of the alcohol groups in the esters may be saturated or unsaturated, and further may be substituted by a halogen. In any case, it is preferable that the organic low-molecular-weight material have at least one atom selected from the group consisting of oxygen, nitrogen, sulfur and a halogen in its molecule. More specifically, it is preferable the organic low-molecular-weight materials comprise, for instance, —OH, —COOH, CONH, —COOR, —NH, —$NH_2$, —S—, —S—S—, —O— or a halogen atom.

In the present invention, it is preferable to use a composite material comprising an organic low-molecular-weight material having a low melting point and an organic low-molecular-weight material having a high melting point as the above-mentioned organic low-molecular-weight material, since the transparent temperature range of the reversible thermosensitive recording layer can be increased by use of such a composite material as the organic low-molecular-weight material. It is preferable that the difference in the melting point between the low-melting point organic low-molecular-weight material and the high melting point organic low-molecular weight material be 20° C. or more, more preferably 30° C. or more, most preferably 40° C. or more.

Specific examples of the above-mentioned organic low-molecular-weight material for use in the present invention are aliphatic saturated dicarboxylic acids; ketones having a higher alkyl group; semicarbazones derived from such ketones; α-phosphonofatty acids; polybasic acid derivatives substituted with a higher alkyl group, such as higher-alkyl-group-substituted maleic acid derivatives, malonic acid derivatives, fumaric acid derivatives, succinic acid derivatives, malic acid derivatives, and citric acid derivatives; alkyl phosphonic acids; and organic acids having hydroxyl group at the α-position thereof, and are not limited to these compounds. These compounds can be used alone or in combination.

Specific examples of the above-mentioned aliphatic dicarboxylic acids are as follows: succinic acid, glutaric acid, adipic acid, pimelic acid, suberic acid, azelaic acid, sebacic acid, undecanedioic acid, dodecanedioic acid, tetradecanedioic acid, pentadecanedioic acid, hexadecanedioic acid, heptadecanedioic acid, octadecanedioic acid, nonadecanedioic acid, eicosanedioic acid, heneicosanedioic acid, and docosanedioic acid.

The ketones for use in the present invention have a ketone group and a higher alkyl group as indispensable constituent groups. The ketones may also have an unsubstituted or substituted aromatic group or heterocyclic group.

It is preferable that the entire number of carbon atoms contained in such ketones be 16 or more,, more preferably 21 or more.

The semicarbazones for use in the present invention are derived from the above-mentioned ketones.

Specific examples of the ketones and semicarbazone for use in the present invention include 2-hexadecanone, 9-heptadecanone, 3-octadecanone, 2-nonadecanone, 7-eicosanone, 2-heneicosanone, 11-heneicosanone, 12-tricosanone, 9-pentacosanone, 9-hexacosanone, 14-heptacosanone, 10-nonacosanone, 16-hentriacontanone, 18-pentatriacontanone, 22-tritetracontanone, decanophenone, tridecanophenone, tetradecanophenone, hexadecanophenone, octadecanophenone, docosanophenone, docosanonaphthophenone, 2-pentadecanonesemicarbazone, 2-octadecanonesemicarbazone, 3-eicosanonesemicarbazone, 2-heneicosanonesemicarbazone, 9-pentacosanonesemicarbazone, 10-nonacosanonesemicarbazone, decanophenonesemicarbazone, octadecanophenonesemicarbazone, and docosanonaphthophenonesemicarbazone.

The α-phosphonofatty acids for use in the present invention can be obtained by the following steps:

A fatty acid is brominated to obtain an α-brominated acid bromide by Hell-Volhard-Zelinskin reaction in accordance with the method by E. V. Kaurer et al. (J.Ak. Oil Chekist's Soc. 41, 205 (1964)).

Ethanol is added to the α-brominated acid bromide to obtain an α-bromofatty acid ester.

The α-bromofatty acid ester is allowed to react with triethyl phosphite with the application of heat thereto, whereby an α-phosphonofatty acid ester.

The thus obtained α-phosphonofatty acid ester is hydrolyzed in the presence of concentrated hydrochloric acid. The product obtained by this hydrolysis is recrystallized from toluene, whereby the α-phosphonofatty acid for use in the present invention is obtained.

Specific examples of the α-phosphonofatty acid for use in the present invention:

α-phosphonopelargonic acid,
$CH_3(CH_2)_6CH[PO(OH)_2]COOH$
(m.p. 130–1° C.)

α-phosphonocaprylic acid,
$CH_3(CH_2)_7CH[PO(OH)_2]COOH$
(m.p. 131–2° C., m.p. 162–4° C.)

α-phosphonolauric acid,
$CH_3(CH_2)_9CH[PO(OH)_2]COOH$
(m.p. 131–2° C., m.p. 162–3° C.)

α-phosphonomyristic acid,
$CH_3(CH_2)_{11}CH[PO(OH)_2]COOH$
(m.p. 132–3° C., m.p. 153–6° C.)

α-phosphonopalmitic acid,
$CH_3(CH_2)_{13}CH[PO(OH)_2]COOH$
(m.p. 132–3° C., m.p. 156–65° C.)

α-phosphonostearic acid
$CH_3(CH_2)_{15}CH[PO(OH)_2]COOH$
(m.p. 130–1° C., m.p. 157–65° C.)

In the above, the acids other than α-phosphonopelargonic acid have two melting points.

Specific examples of the polybasic acids substituted with a higher alkyl group are malonic acid derivatives such as tetradecylmalonic acid, hexadecylmalonic acid, octadecylmalonic acid and eicocylmalonic acid; maleic acid derivatives such as octylmaleic acid and decylmaleic acid; fumaric acid derivatives such as heptylfumaric acid, hexadecylfumaric acid and dococylfumaric acid; succinic acid derivatives such as tetradecylsuccinic acid, hexadecylsuccinic acid, octadecylsuccinic acid, eicocylsuccinic acid and dococylsuccinic acid; malic acid derivatives such as dodecylmalic acid, dodecylthiomalic acid, tetradecylmalic acid, tetradecylthiomalic acid, hexadecylmalic acid, hexadecylthiomalic acid, octadecylmalic acid, octadecylthiomalic acid, eicocylmalic acid, eicocylthiomalic acid, dococylmalic acid, dococylthiomalic acid, dodecyldithiomalic acid, octadecyldithiomalic acid, tetradecyloylmalic acid and octadecyloylmalic acid; and citric acid derivatives such as octanoylcitric acid, decanoylcitric acid, tetradecanoylcitric acid, hexadecanoylcitric acid and docosanoylcitric acid.

The previously mentioned alkylphosphoric acids have the following general formula:

$$R^1—PO(OH)_2$$

wherein $R^1$ is a straight chain or branched alkyl group or alkenyl group having 8 to 30 carbon atoms.

Specific examples of the above alkylphosphoric acids are octylphosphonic acid, nonylphosphonic acid, decylphosphonic acid, dodecylphosphonic acid, tetradecylphosphonic acid, hexadecylphosphonic acid, octadecylphosphonic acid, eicocylphosphonic acid, dococylphosphonic acid and tetracosilphosphonic acid.

The previously mentioned organic acids having hydroxyl group at the α-position thereof have the following general formula:

$$R^2—CH(OH)COOH$$

wherein $R^2$ is a straight-chain or branched alkyl or alkenyl group having 6 to 28 carbon atoms.

Specific examples of the organic acids having hydroxyl group at the α-position thereof are α-hydroxyoctanoic acid, α-hydroxydodecanoic acid, α-hydroxytetradecanoic acid, α-hydroxyhexadecanoic acid, α-hydroxyoctadecanoic acid, α-hydroxypentadecanoic acid, α-hydroxyeicosanoic acid and α-hydroxydocosanoic acid.

As mentioned previously, in order to expand the transparent temperature range of the reversible thermosensitive recording layer in the present invention, the above-mentioned organic low-molecular-weight materials may be appropriately used in combination. Alternatively, any of the above-mentioned organic low-molecular-weight materials and other materials having different melting points from the melting points of the above-mentioned organic low-molecular-weight materials may be used in combination. Such materials are disclosed in Japanese Laid-Open Patent Applications 63-39378 and 63-130380, and Japanese Applications 63-14754 and 3-2089, but the materials to be used in combination with the above-mentioned organic low-molecular-weight materials are not limited to the materials proposed in the above references.

It is preferable that the ratio by weight of the organic low-molecular-weight material to the matrix resin which is a resin having a crosslinked structure be in the range of 2:1 to 1:16, more preferably in the range of 1:2 to 1:8.

When the amount of the resin is in the above-mentioned range, a resin film which can hold the organic low-molecular-weight material can be appropriately formed, and which can be reversible made transparent, can be prepared.

In addition to the above-mentioned components, additives such as a surfactant and a plasticizer may be added to the reversible thermosensitive recording layer in order to facilitate the formation of transparent images.

Examples of the plasticizer include phosphoric ester, fatty acid ester, phthalic acid ester, dibasic acid ester, glycol, polyester-based plasticizers, and epoxy plasticizers.

Specific examples of such plasticizers are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol di-2-ethyl butyrate, methyl acetylricinoleate, butyl acetylricinoleate, butylphthalyl butyl glycolate and tributyl acetylcitrate.

Specific examples of the surfactant and other additives are polyhydric alcohol higher fatty acid esters; polyhydric alcohol higher alkyl ethers; lower olefin oxide adducts of polyhydric alcohol higher fatty acid ester, higher alcohol, higher alkyl phenol, higher alkyl amine of higher fatty acid, amide of higher fatty acid, fat and oil, and propylene glycol; acetylene glycol; sodium, calcium, barium and magnesium salts of higher alkylbenzenesulfonic acid; calcium, barium and magnesium salts of aromatic carboxylic acid, higher aliphatic sulfonic acid, aromatic sulfonic acid, sulfonic monoester, phosphoric monoester and phosphoric diester; lower sulfated oil; long-chain polyalkyl acrylate; acrylic oligomer; long-chain polyalkyl methacrylate; long-chain alkyl methacrylate-amine-containing monomer copolymer; styrene-maleic anhydride copolymer; and olefin-maleic anhydride copolymer.

The matrix resin for use in the reversible thermosensitive recording layer can be crosslinked by the application of heat, ultraviolet light radiation, or electron beam radiation. Of these crosslinking methods, electron beam radiation is the most suitable for crosslinking the matrix resin in the present invention.

More specifically the methods of crosslinking can be classified as follows:

(1) Method of performing the crosslinking by using a resin that can be crosslinked.

(2) Method of performing the crosslinking by use of a crosslinking agent.

(3) Method of performing the crosslinking by ultraviolet light radiation or electron beam radiation.

(4) Method of performing the crosslinking by ultraviolet light radiation or electron beam radiation in the presence of a cross-linking agent.

Examples of the cross-linking agent for use in electron beam radiation include the following non-functional monomers and functional monomers:

Specific examples of the non-functional monomer:
Methyl methacrylate (MMA),
Ethyl methacrylate (EMA),
n-Butyl methacrylate (BMA),
i-Butyl methacrylate (IBMA),
t-Butyl methacrylate (TBMA),
2-Ethylhexyl methacrylate (EHMA),
Lauryl methacrylate (LMA),
Alkyl methacrylate (SLMA),
Tridecyl methacrlate (TDMA),
Stearyl methacrylate (SMA),
Cyclohexyl methacrylate (CHMA), and
Benzyl methacrylate (BZMA).

Specific examples of mono-functional monomers:
Methacrylic acid (MMA),
2-Hydroxyethyl methacrylate (HEMA),
2-Hydroxypropyl methacrylate (HPMA),
Dimethylaminoethyl methacrylate (DE),
Dimethylaminoethyl methylchloride salt methacrylate (DMCMA),
Diethylaminoethyl methacrylate (DEMA),
Glycidyl methacrylate (GMA),
Tetrahydrofurfuryl methacrylate (THFMA),
Allyl methacrylate (AMA),
Ethylene glycol dimethacrylate (EDMA),
Triethylene glycol dimethacrylate (3EDMA),
Tetraethylene glycol dimethacrylate (4EDMA),
1,3-Butylene glycol dimethacrylate (BDMA),
1,6-Hexanediol dimethacrylate (HXMA),
Trimethylolpropane trimethacrylate (TMPMA),
2-Ethoxyethyl methacrylate (ETMA),
2-Ethylhexyl acrylate,
Phenoxyethyl acrylate,
2-Ethoxyethyl acrylate,
2-Ethoxyethoxyethyl acrylate,
2-Hydroxyethyl acrylate,
2-Hydroxypropyl acrylate,
Dicyclopentenyloxy ethyl acrylate,
N-Vinyl pyrrolidone, and
Vinyl acetate.

Specific examples of di-functional monomer:
1,4-Butanediol acrylate,
1,6-Hexanediol diacrylate,
1,9-Nonanediol diacrylate,
Neopentyl glycol diacrylate,
Tetraethylene glycol diacrylate,
Tripropylene glycol diacrylate,
Tripropylene glycol diacrylate,
Polypropylene glycol diacrylate,
Bisphenol A. EO adduct diacrylate,

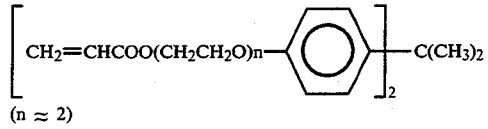

Glycerin methacrylate acrylate,

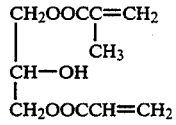

Diacrylate with 2-mole adduct of propylene oxide of neopentyl glycol,
Diethylene glycol diacrylate,
Polyethylene glycol (400) diacrylate,
Diacrylate of the ester of hydroxypivalic acid and neopentyl glycol,
2,2-Bis(4-acryloxy.diethoxyphenyl)propane,
Diacrylate of neopentyl glycol adipate,

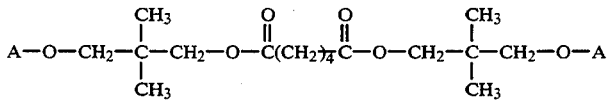

wherein A is

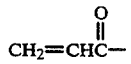

(acryloyl group)

Diacrylate of ϵ-caprolactone adduct of neopentyl glycol hydroxypivalate

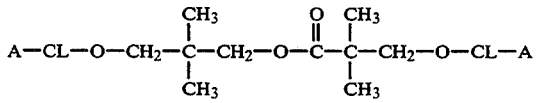

wherein CL is

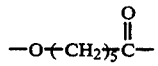

(ϵ-caprolactone)

Diacrylate of α-caprolactone adduct of neopentyl glycol hydroxypivalate,

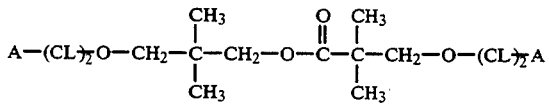

2-(2-hydroxy-1,1-dimethylethyl)-5-hydroxymethyl-5-ethyl-1,3-dioxanediacrylate

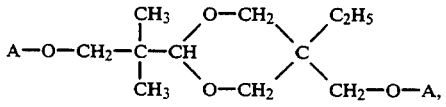

Tricyclodecanedimethylol diacrylate

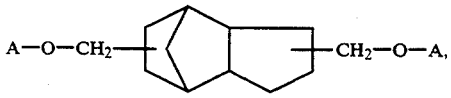

ε-Caprolactone adduct of tricyclodecanedimethylol diacrylate

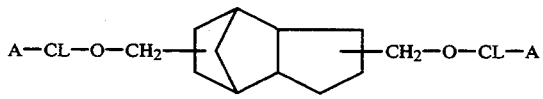

Diacrylate of diglycidyl ether of 1,6-hexanediol,

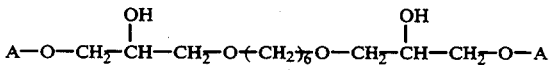

Specific examples of polyfunctional monomer:
Trimethylolpropane triacrylate,
Pentaerythritol triacrylate,
Glycerine PO-adduct triacrylate,
Trisacryloyloxyethyl phosphate,
Pentaerythritol tetraacrylate,
Triacrylate with 3-mole adduct of propylene oxide of trimethylol propane,
Glycerylpropoxy triacrylate,
Dipentaerythritol.polyacrylate
Polyacrylate of caprolactone adduct of dipentaerythritol,
Propionic acid.dipentaerythritol triacrylate,
Hydroxypivalaldehyde-modified dimethylolpropine triacrylate,
Tetraacrylate of propionic acid.dipentaerythritol,
Ditrimethylolpropane tetraacrylate,
Pentaacrylate of dipentaerythritol propionate,
Dipentaerythritol hexaacrylate (DPHA)
ε-caprolactone adduct of DPHA,

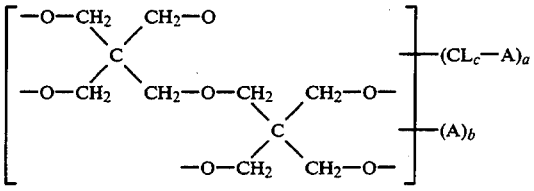

(DPCA-20) a = 2, b = 4, c = 1
(DPCA-30) a = 3, b = 3, c = 1
(DPCA-60) a = 6, c = 1
(DPCA-120) a = 6, c = 2

An example of oligomer:
Bisphenol A—diepoxyacrylic acid adduct,

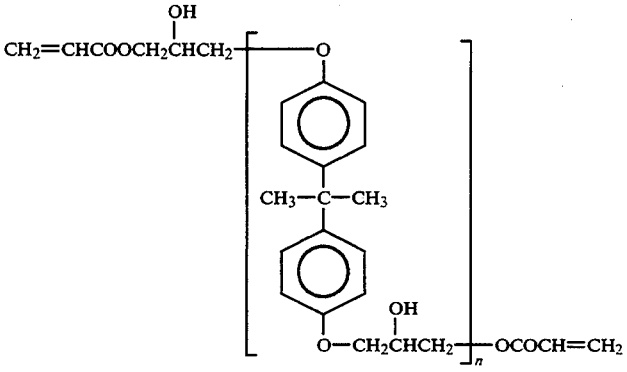

These crosslinking agents can be used alone or in combination. It is preferable that the amount of such a crosslinking agent to be added be in the range of 0.001 to 1.0 parts by weight, more preferably in the range of 0.01 to 0.5 parts by weight, to 1 part by weight of the matrix resin. This is because there is the tendency that when the amount of the cross-linking agent is less than 0.001 parts by weight to 1 part by weight of the matrix resin, the crosslinking effect becomes insufficient, while when the amount of the cross-linking agent exceeds 1.0 part by weight, the milky white opaqueness of the reversible thermosensitive recording layer decreases and therefore image contrast decreases.

In order to increase the crosslinking efficiency by minimizing the amount of such a cross-linking agent added, the functional monomers are better than non-functional monomers, and the polyfunctional monomers are better than the monofunctional monomers.

When the above crosslinking is performed by ultraviolet radiation, the following cross-linking agents, photopolymerization initiators and photopolymerization promoters can be employed, although the cross-linking agents, photopolymerization initiators and photopolymerization promoters for use in the present invention are not limited to them.

More specifically, the cross-linking agents for use in the ultraviolet radiation can be roughly classified into photopolymerizable prepolymers and photopolymerizable monomers.

As the photopolymerizable monomers, the previously mentioned mono-functional monomers and polyfunctional monomers for use in the electron beam radiation can be employed.

As the photopolymerizable prepolymers, for instance, polyester acrylate, polyurethane acrylate, epoxy acrylate, polyether acrylate, oligoacrylate, alkyd acylate, and polyol acrylate can be employed.

These crosslinking agents can be used alone or in combination. It is preferable that the amount of such a crosslinking agent to be added be in the range of 0.001 to 1.0 parts by weight, more preferably in the range of 0.01 to 0.5 parts by weight, to 1 part by weight of the matrix resin. This is because there is the tendency that when the amount of the cross-linking agent is less than 0.001 parts by weight to 1 part by weight of the matrix resin, the crosslinking effect becomes insufficient, while when the amount of the cross-linking agent exceeds 1.0 part by weight, the milky white opaqueness of the reversible thermosensitive recording layer decreases and therefore image contrast decreases.

The photopolymerization initiators can be roughly classified into radical reaction type initiators and ionic reaction type initiators. The radical reaction type initiators can be further classified into photo-cleavage type initiators and hydrogen-pulling type initiators.

Specific examples of initiators for use in the present invention are as follows:

1. Benzoin ethers
Isobutyl benzoin ether

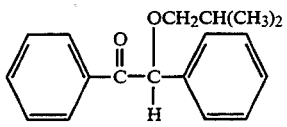

Isopropyl benzoin ether

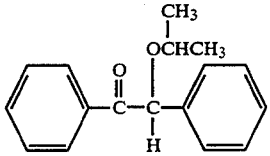

Benzoin ethyl ether

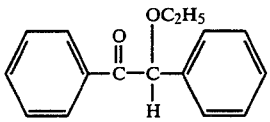

Benzoin methyl ether

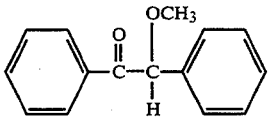

2. α-Acyloxime ester
1-phenyl-1,2-propanedion-2-(o-ethoxycarbonyl)oxime

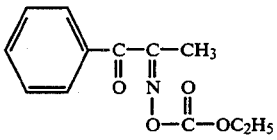

3. Benzyl ketals
2,2-Dimethoxy-2-phenyl-acetophenone

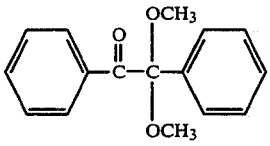

4. Acetophenone derivatives
Diethoxy acetophenone

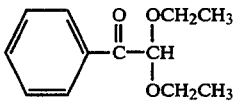

2-Hydroxy-2-methyl-1.phenyl-propane-1-on

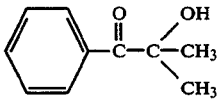

5. Benzophenone derivatives
Benzophenone

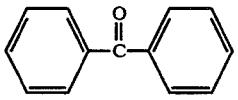

-continued

| | |
|---|---|
| Chlorine-substituted benzophenone | 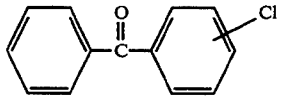 |
| 6. Xanthone derivatives<br>Chlorothioxanthone | 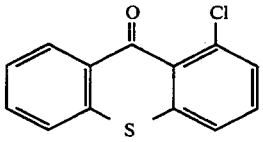 |
| 2-Chlorothioxanthone | 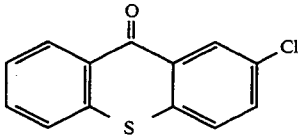 |
| Isopropyl thioxanthone | 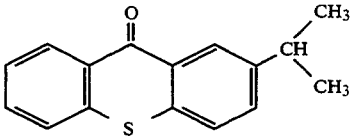 |
| 2-Methyl thioxanthone | 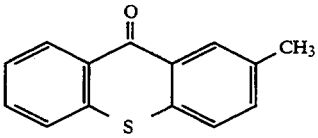 |
| Benzyl | 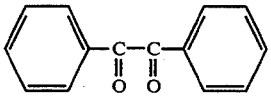 |
| Hydroxycyclohexyl phenyl ketone | 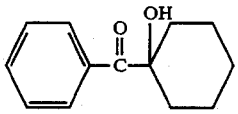 |

These photopolymerization initiators can be used alone or in combination. It is preferable to employ such an initiator in an amount in the range of 0.005 to 1.0 parts by weight, more preferably in the range of 0.01 to 0.5 parts by weight, to 1 part of any of the previously mentioned cross-linking agents.

Photopolymerization promoters have a hardening-rate-increasing effect on the hydrogen-pulling type photopolymerization initiators such as benzophenone type and thioxanthone type initiators. There are aromatic tertiary amine type photopolymerization promotors and aliphatic amine type photopolymerization promotors.

Specific examples of such photopolymerization initiators are as follows:

Isoamyl p-dimethylaminobenzoate

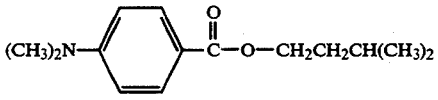

Ethyl p-dimethylaminobenzoate

-continued

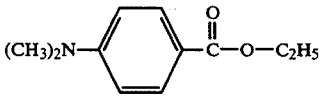

These photopolymerization promotors can be used alone or in combination. It is preferable to employ such a photopolymerization promotor in an amount of 0.1 to 5 parts by weight, more preferably in an amount of 0.3 to 3 parts by weight, to 1 part by weight of a photopolymerization initiator.

An ultraviolet light radiation apparatus for use in the present invention is composed of a light source, a radiation unit, a power source, a cooling unit, and a transportation unit. As the light source, a mercury lamp, a metal halide lamp, a gallium lamp, a mercury xenon lamp, or a flush lamp may be employed. However any light source can be employed as long as it has a light emitting spectrum corresponding to the ultraviolet absorption wavelength for the previously mentioned photopolymerization initiators and photopolymerization promotors.

As to the conditions for ultraviolet light radiation, the lamp output and transportation speed may be determined in accordance with the radiation energy necessary for crosslinking the resin to be crosslinked.

In the present invention, the following is a particularly effective electron beam radiation method for crosslinking the resin in the reversible thermosensitive recording layer of the reversible thermosensitive recording medium of the present invention.

Generally EB (electron beam) radiation apparatus can be classified into a scan beam EB radiation apparatus and an area beam EB radiation apparatus. An appropriate EB radiation apparatus is chosen in accordance with the desired radiation area, exposure and other factors.

The EB radiation conditions can be determined by the following formula in accordance with the necessary exposure of the resin to be crosslinked to electron beam, with the current, radiation width and transportation speed being taken into consideration:

$$D=(\Delta E/\Delta R)\cdot\eta\cdot I/(W\cdot V)$$

where

D: Necessary exposure to electron beam (Mrad)

$\Delta E/\Delta R$: Average energy loss $\eta$: Efficiency

I: Current (mA)

W: Radiation width (cm)

V: Transportation speed (cm/s)

For industrial purpose, the above formula is simplified as $D\cdot V=K\cdot I/W$, and the apparatus rating is indicated by Mrad·m/min.

The current rating is selected in such a manner that about 20 to 30 mA is for an experimental apparatus, about 50 to 100 mA is for a pilot apparatus and about 100 to 500 mA is for an industrial apparatus.

As to the necessary exposure of the resin to electron beam for crosslinking the resin, the crosslinking efficiency varies in accordance with the kind of a resin to be crosslinked, the polymerization degree thereof, the kind of the crosslinking agent employed, the amount thereof, the kind of the plasticizer employed, the amount thereof and other factors, so that the gel percentage of the resin is not always constant for a constant exposure to electron beam. Therefore, a reversible thermosensitive recording layer of a reversible thermosensitive recording medium is fabricated in accordance with the levels for the constituent factors therefor, and the desired gel percentage is determined. Thus the necessary exposure to electron beam is then determined in accordance with the desired gel percentage.

In the case where high energy is required for crosslinking the resin, it is preferable that the radiation of electron beam to the resin be separately performed a plurality of times in order to avoid the deformation or thermal decomposition of the resin or the support for the reversible thermosensitive recording medium by the heat generated by the application of electron beam with high energy.

It is preferable that prior to the crosslinking of the resin by electron beam radiation, the resin in the reversible thermosensitive recording layer be heated to a temperature at which at least part of the organic low-molecular-weight material contained in the recording layer be melted or the organic low-molecular-weight material be melted in its entirety.

The relationship between the constituent factors for the reversible thermosensitive recording layer and the gel percentage of the resin is as follows:

As the resin for the reversible thermosensitive recording layer, any of the previously mentioned resins can be employed. However, there is the tendency that the gel percentage is increased as the polymerization degree (P) of the resin is increased. Therefore it is preferable that the polymerization degree (P) be 300 or more, more preferably 600 or more.

As to the kinds of cross-linking agent that can be employed in the present invention and the amount thereof to be employed have been described previously. As the plasticizer for use in the reversible thermosensitive recording layer, fatty acid ester, polyester plasticizers, and epoxy plasticizers are preferable. Of these plasticizers, epoxy plasticizers are particularly preferable for use in the present invention. As to the amount of such a plasticizer to be added, there is the tendency that the gel percentage is increased as the amount of the plasticizer added is increased. Therefore it is preferable that such a plasticizer be added in an amount of 0.01 to 1.0 parts by weight, more preferably in an amount of 0.05 to 0.5 parts by weight, to 1 part by weight of the resin.

In the case where there are vacant gaps with a refractive index which is different from the refractive indexes of the matrix resin and the organic low-molecular-weight material at the interfaces between the matrix resin and the particles of the organic low-molecular-weight material and/or within the particles of the organic low-molecular-weight material in the reversible thermosensitive recording layer, the image density in the milky white state is improved and accordingly the image contrast is also improved. This effect is significant when the size of such vacant gaps be 1/10 or more the wavelength of the light for detecting the milky white opaque state.

In the case where images formed in this reversible thermosensitive recording medium are used as reflection images, it is preferable to place a light reflection layer behind the reversible thermosensitive recording layer of the recording medium. When such a light reflection layer is provided, the image contrast can be increased even when the reversible thermosensitive recording layer is thin. Examples of such a light reflection layer made by vacuum deposition of Al, Ni, Sn or the like are disclosed in Japanese Laid-Open Patent Application 64-14079.

As mentioned previously, a protective layer may be provided on the reversible thermosensitive recording layer. Examples of the material for such a protective layer having a thickness of 0.1 to 10 $\mu$m are silicone rubber and silicone resin as disclosed in Japanese Laid-Open Patent Application 63-221087, polysiloxane graft polymer as disclosed in Japanese Patent Application 62-152550, and ultraviolet curing resin and electron beam curing resin as disclosed in Japanese Patent Application 63-310600.

When a protective layer is formed by use of any of the above-mentioned materials, a solvent is used for coating the protective layer. It is preferable that the solvent for use this object be such a solvent that the resin for the reversible thermosensitive recording layer and the organic low-molecular-weight material are not soluble or slightly soluble in the solvent.

Specific examples of such a solvent include n-hexane, methyl alcohol, ethyl alcohol, and isopropyl alcohol. In view of the cost, alcohol solvents are preferable.

It is possible to cure the protective layer simultaneously with the crosslinking of the matrix resin in the reversible thermosensitive recording layer. In this case, the reversible thermosensitive recording layer is formed on a support by the previously mentioned method, and a protective layer formation liquid is coated on the recording layer and dried. Thereafter, the coated protective layer and the recording layer are both cured by being subjected to electron beam by the previously mentioned electron beam radiation apparatus under the previously mentioned conditions, or to ultraviolet light by the previously mentioned ultraviolet light radiation apparatus under the previously mentioned conditions.

In order to protect the reversible thermosensitive recording layer from the solvent and/or monomer which is employed for the formation of the protective layer, an intermediate layer may be interposed between the protective layer and the reversible thermosensitive recording layer as disclosed in Japanese Laid-Open Patent Application 1-133781. As the material for the intermediate layer, the same materials as those for the matrix resin for the reversible thermosensitive recording layer can be employed. In addition to those materials, the following thermosetting resins and thermoplastic resins can be employed. Specific examples of such resins are polyethylene, polypropylene, polystyrene, polyvinyl alcohol, polyvinyl butyral, polyurethane, saturated polyester, unsaturated polyester, epoxy resin, phenolic resin, polycarbonate, and polyamide.

It is preferable that the intermediate layer have a thickness in the range of 0.1 to 2 μm.

In order to make the images formed in the reversible thermosensitive layer clear and more easily visible, a colored layer may be interposed between the support and the recording layer.

Such a colored layer can be formed by coating a solution or dispersion of a coloring agent and a binder resin to the surface to be coated therewith, drying the coated solution or dispersion. Alternatively, the colored layer may be formed by applying a colored sheet to the subject surface.

As the coloring agent for use in the colored layer, any dyes and pigments can be employed as long as the transparent and milky white images formed on the recording layer which is situated above the colored layer can be made recognizable as reflection images, so that dyes and pigments with colors such as red, yellow, blue, dark blue, purple, black, brown, grey, orange and green can be employed.

As the binder resin for the colored layer, varieties of thermoplastic resins, thermosetting resins and ultraviolet-curing resins can be employed.

An air layer which constitutes a non-contact portion can be interposed between the support and the reversible thermosensitive recording layer.

When such an air layer is interposed between the support and the recording layer, a large difference in the refractive index is formed between the recording layer and the air layer because the refractive indexes of the organic polymeric materials for the recording layer are in the range of about 1.4 to 1.6, while the refractive index of the air in the air layer is 1.0.

Therefore, light is reflected at the interface between the surface of the support on the side of the recording layer and the air layer which constitutes the non-contact portion, so that when the recording layer is in the milky white state, the milky white opaqueness is intensified, and therefore the images can be made more easily visible. Therefore it is preferable that such a non-contact portion be employed as a display portion of the reversible thermosensitive recording medium.

The non-contact portion contains air therein, so that the non-contact portion serves as a heat insulating layer. Therefore the thermosensitivity of the recording layer on the non-contact portion is improved.

The non-contact portion also serves as a cushion, so that even when a thermal head is brought into pressure contact with the recording layer, the pressure actually applied to the recording layer is reduced and the deformation of the recording layer, if any, is minimal. Therefore, the particles of the organic low-molecular-weight material are not depressed flat or deformed. Thus, the repeated use durability of the reversible thermosensitive recording layer is improved.

Furthermore, it is also possible to apply an adhesive layer to the back side of the support opposite to the recording layer of the reversible thermosensitive recording medium in order to use the reversible thermosensitive recording medium as a reversible thermosensitive recording label sheet. Such a reversible themosensitive recording label sheet can be applied to a base sheet or plate. Examples of such a base sheet or plate are polyvinyl chloride cards for credit cards, IC cards, ID cards, paper, film, synthetic paper, boarding pass, and commuter's pass. The above-mentioned base sheet or plate are not limited to these sheets or cards.

In the case where the support is, for example, an aluminum-deposited layer which has poor adhesiveness to a resin, an adhesive layer may be interposed between the support and the reversible thermosensitive recording layer as disclosed in Japanese Laid-Open Patent Application 3-7377.

Other features of this invention will become apparent in the course of the following description of exemplary embodiments, which are given for illustration of the invention and are not intended to be limiting thereof.

EXAMPLE 1

Formation of Adhesive Layer

A mixture of the following components was dispersed to prepare a coating liquid for the formation of an adhesive layer:

| | Parts by Weight |
|---|---|
| Vinyl chloride - vinyl acetate - vinyl alcohol copolymer (Trademark "VAGH" made by UCC Company, Ltd.) | 10 |
| Methyl ethyl ketone | 45 |
| Toluene | 45 |

This coating liquid was coated on a transparent PET (polyethylene terephthalate) film with a thickness of about 100 μm (Trademark "HSL" made by Teijin, Ltd.) by a wire bar and dried with the application of heat thereto, whereby an adhesive layer with a thickness of about 1 μm was formed on the transparent PET film.

Formation of Reversible Thermosensitive Recording Layer

A mixture of the following components was dispersed to prepare a coating liquid for the formation of a reversible thermosensitive recording layer:

| | Parts by Weight |
|---|---|
| Eicosanedioic acid (Trademark "SL20-99" made by Okamura Oil Mill, Ltd.) | 1 |
| Polystyrene (M.W. 280,000, reagent made by Aldrich Co., Ltd.) | 6 |
| THF | 30 |

-continued

| | Parts by Weight |
|---|---|
| Toluene | 3 |

This coating liquid was coated on the adhesive layer by a wire bar and dried with the application of heat thereto, whereby a reversible thermosensitive recording layer with a thickness of about 15 μm was provided on the adhesive layer. Thus, a reversible thermosensitive recording medium No. 1 of the present invention was fabricated.

EXAMPLE 2

The procedure for the fabrication of the reversible thermosensitive recording medium No. 1 of the present invention in Example 1 was repeated except that the polystyrene employed in the formulation of the reversible thermosensitive recording layer in Example 1 was replaced by a polycarbonate with the following composition:

A [mol. %]/B [mol. %] = 96.5/3.5

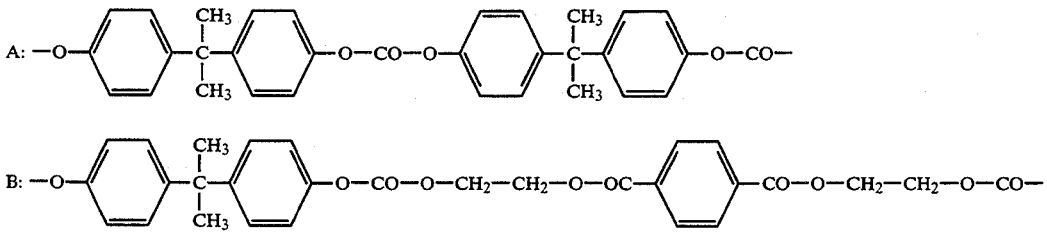

Thus, a reversible thermosensitive recording medium No. 2 of the present invention was fabricated.

EXAMPLE 3

The procedure for the fabrication of the reversible thermosensitive recording medium No. 2 of the present invention in Example 2 was repeated except that the composition of the polycarbonate employed in Example 2 was changed as follows:

A[mol. %]/B[mol. %]=96/4

Thus, a reversible thermosensitive recording medium No. 3 of the present invention was fabricated.

EXAMPLE 4

The procedure for the fabrication of the reversible thermosensitive recording medium No. 2 of the present invention in Example 2 was repeated except that the composition of the polycarbonate employed in Example 2 was changed as follows:

A[mol. %]/B[mol. %]=92/8

Thus, a reversible thermosensitive recording medium No. 4 of the present invention was fabricated.

EXAMPLE 5

The procedure for the fabrication of the reversible thermosensitive recording medium No. 1 of the present invention in Example 1 was repeated except that the polystyrene with a molecular weight of 280,000 employed in the formulation of the reversible thermosensitive recording layer in Example 1 was replaced by a polystyrene with a molecular weight of 24,000 (polystyrene reagent made by Aldrich Co., Ltd.), whereby a reversible thermosensitive recording medium No. 5 of the present invention was fabricated.

EXAMPLE 6

The procedure for the fabrication of the reversible thermosensitive recording medium No. 1 of the present invention in Example 1 was repeated except that the polystyrene with a molecular weight of 280,000 employed in the formulation of the reversible thermosensitive recording layer in Example 1 was replaced by a polystyrene with a molecular weight of 13,000 (polystyrene reagent made by Aldrich Co., Ltd.), whereby a reversible thermosensitive recording medium No. 6 of the present invention was fabricated.

EXAMPLE 7

The procedure for the fabrication of the reversible thermosensitive recording medium No. 1 of the present invention in Example 1 was repeated except that the polystyrene with a molecular weight of 280,000 employed in the formulation of the reversible thermosensitive recording layer in Example 1 was replaced by a polystyrene with a molecular weight of 4,000 (polystyrene reagent made by Aldrich Co., Ltd.), whereby a reversible thermosensitive recording medium No. 7 of the present invention was fabricated.

EXAMPLE 8

The procedure for the fabrication of the reversible thermosensitive recording medium No. 1 of the present invention in Example 1 was repeated except that the polystyrene employed in the formulation of the reversible thermosensitive recording layer in Example 1 was replaced by a vinyl chloride-vinyl acetate copolymer (Trademark "VYHH" made by UCC Company, Ltd.), whereby a reversible thermosensitive recording medium No. 8 of the present invention was fabricated.

EXAMPLE 9

The procedure for the fabrication of the reversible thermosensitive recording medium No. 1 of the present invention in Example 1 was repeated except that the eicosandioic acid employed in the formulation of the reversible thermosensitive recording layer in Example 1 was replaced by stearyl thiomalic acid, whereby a reversible thermosensitive recording medium No. 9 of the present invention was fabricated.

Comparative Example 1

The procedure for the fabrication of the reversible thermosensitive recording medium No. 1 of the present invention in Example 1 was repeated except that the eicosandioic acid employed in the formulation of the reversible thermosensitive recording layer in Example 1 was replaced by behenic acid (made by Sigma Chemical Corporation), whereby a comparative reversible thermosensitive recording medium No. 1 was fabricated.

Comparative Example 2

The procedure for the fabrication of the reversible thermosensitive recording medium No. 1 of the present invention in Example 1 was repeated except that the eicosandioic acid employed in the formulation of the reversible thermosensitive recording layer in Example 1 was replaced by behenic acid (made by Sigma Chemical Corporation) and that the polystyrene employed in the formulation of the reversible thermosensitive recording layer in Example 1 was replaced by a vinyl chloride-vinyl acetate copolymer (Trademark "VYHH" made by UCC Company, Ltd.), whereby a comparative reversible thermosensitive recording medium No. 2 was fabricated.

Comparative Example 3

The procedure for the fabrication of the reversible thermosensitive recording medium No. 1 of the present invention in Example 1 was repeated except that the eicosandioic acid employed in the formulation of the reversible thermosensitive recording layer in Example 1 was replaced by cerotic acid (made by Sigma Chemical Corporation), whereby a comparative reversible thermosensitive recording medium No. 3 was fabricated.

Comparative Example 4

The procedure for the fabrication of the reversible thermosensitive recording medium No. 1 of the present invention in Example 1 was repeated except that the eicosandioic acid employed in the formulation of the reversible thermosensitive recording layer in Example 1 was replaced by cerotic acid (made by Sigma Chemical Corporation) and that the polystyrene employed in the formulation of the reversible thermosensitive recording layer in Example 1 was replaced by a vinyl chloride-vinyl acetate copolymer (Trademark "VYHH" made by UCC Company, Ltd.), whereby a comparative reversible thermosensitive recording medium No. 4 was fabricated.

Part of the reversible thermosensitive recording layer was scraped off from each of the thus fabricated reversible thermosensitive recording media by use of a knife to prepare a test sample of the recording layer, and the endothermic/exothermic properties of the organic low-molecular-weight material contained in each test sample were investigated by use of a commercially available differential scanning calorimeter (Trademark "DSC 3100") made by Mac Science Company, Ltd.

Furthermore, changes in the logarithmic attenuation factor of each recording layer during the temperature elevation process were investigated by use of the previously mentioned "Rheovibron DDV-OPA III" (Trademark) made by Orientec Company, Ltd.

TABLE 1 shows the higher crystallization temperature ($T_{B1}$) and the lower crystallization temperature ($T_{B2}$) of the organic low-molecular-weight material in each test sample and the softening initiation temperature ($T_A$) of each recording layer, which were obtained by the abovementioned investigations.

Furthermore, TABLE 1 shows the reflection density of each of the maximum milky white state and the maximum transparent state in each reversible thermosensitive recording medium, which was measured with a black sheet with a reflection density of 2.0 being placed therebehind, and with the heat application temperature being appropriately changed.

Furthermore, TABLE 1 shows the changes in the value of the milky white density of each reversible thermosensitive recording medium when milky white images were formed in the reversible thermosensitive recording medium and the white-image bearing thermosensitive recording medium was placed at 80° C. and at 90° C. for 24 hours.

TABLE 1

| | $T_{B1}$ (°C.) | $T_{B2}$ (°C.) | $T_A$ (°C.) | Milky White Density | Transparent Density | Contrast | Preservation of High Temperatures 80° C. | 90° C. |
|---|---|---|---|---|---|---|---|---|
| Example 1 | 122 | 55 | 100 | 0.72 | 1.60 | 0.88 | 0.04 | 0.05 |
| 2 | 122 | 55 | 118 | 0.66 | 1.41 | 0.75 | 0.01 | 0.03 |
| 3 | 122 | 55 | 104 | 0.67 | 1.52 | 0.85 | 0.02 | 0.03 |
| 4 | 122 | 55 | 93 | 0.72 | 1.60 | 0.88 | 0.05 | 0.08 |
| 5 | 122 | 55 | 92 | 0.74 | 1.62 | 0.88 | 0.05 | 0.10 |
| 6 | 122 | 55 | 85 | 0.73 | 1.64 | 0.91 | 0.10 | 0.35 |
| 7 | 122 | 55 | 65 | 0.80 | 1.65 | 0.85 | 0.40 | 0.05 |
| 8 | 122 | 55 | 60 | 0.90 | 1.65 | 0.75 | 0.45 | 0.52 |
| 9 | 110 | 45 | 100 | 0.75 | 1.61 | 0.86 | 0.05 | 0.06 |
| Comp. Example 1 | 77 | 40 | 100 | 0.73 | 0.77 | 0.04 | — | — |
| 2 | 77 | 40 | 60 | 0.75 | 1.45 | 0.70 | Transparent portions were made milky white | Transparent portions were made milky white |
| 3 | 84 | 55 | 100 | 0.70 | 0.75 | 0.05 | — | — |
| 4 | 84 | 55 | 60 | 0.73 | 1.60 | 0.87 | 0.80 | Transparent portions were made milky white |

EXAMPLE 10

The procedure for the fabrication of the reversible thermosensitive recording medium No. 1 of the present invention in Example 1 was repeated except that a protective layer was further provided on the reversible thermosensitive recording layer in Example 1.

The protective layer was formed on the recording layer as follows:

The following components were mixed to prepare a coating liquid for the formation of a protective layer:

| | Parts by Weight |
|---|---|
| 75% butyl acetate solution of urethane acrylate based ultraviolet curing resin (Trademark "Unidic C7-157, made by Dainippon Ink & Chemicals, Inc.) | 10 |
| IPA | 10 |

The thus prepared coating liquid was coated on the recording layer by a wire bar, dried with the application of heat thereto, and cured with ultraviolet light by use of an 80 W/cm ultraviolet lamp, whereby a protective layer with a thickness of about 2 μm was formed on the recording layer.

Thus, a reversible thermosensitive recording medium No. 10 of the present invention was fabricated.

EXAMPLE 11

The procedure for the fabrication of the reversible thermosensitive recording medium No. 1 of the present invention in Example 1 was repeated except the following step (1) was modified and the following step (2) was added:

(1) The formulation of the coating liquid for the formation of a reversible thermosensitive recording layer employed in Example 1 was changed as follows:

| | Parts by Weight |
|---|---|
| Eicosanedioic acid (Trademark "SL20-99" made by Okamura Oil Mill, Ltd.) | 1 |
| Polystyrene (M.W. 280,000, reagent made by Aldrich Co., Ltd.) | 6 |
| Polyfunctional monomer (Trademark "DPCA-30" made by Nippon Kagaku Co., Ltd.) | 1 |
| THF | 30 |
| Toluene | 3 |

The thus formed coating liquid for the formation of the recording layer was coated on the adhesive layer, and the coated liquid was exposed to electron beam with an irradiation dose of 30 Mrad by use of a commercially available electron beam irradiation apparatus (Trademark "Area Beam Type Electron Beam Irradiation Apparatus EBC-200-AA2" made by Nisshin High Voltage Co., Ltd.) for crosslinking the resin in the recording layer, whereby a recording layer was formed.

(2) The same protective layer as prepared in Example 10 was formed on the recording layer in the same manner as in Example 10.

Thus, a reversible thermosensitive recording medium No. 12 of the present invention was fabricated.

Durability Test

The reversible thermosensitive recording media No. 10 and No. 11 of the present invention, which were respectively fabricated in Example 10 and Example 11, were subjected to a durability test by repeating image formation and erasure under the following conditions:

As the image formation apparatus, a thermal head printing test machine made by Yashiro Denki Co., Ltd. was employed, and as the thermal head for use in the thermal head printing test machine, an 8 dots/mm thermal head my by Ricoh Company, Ltd. was employed.

Milky white images were formed under the conditions that the pulse width was 2 msec and the applied voltage was 20.0 V.

Image erasure was performed by use of a hot stamp at an image erasing temperature of 110° C., with the application of a pressure of 1 kg/cm$^2$ for 1.0 sec.

Each of these reversible thermosensitive image recording media was subjected to a 100-cycle image formation and erasure durability test in which one cycle of image formation and erasure contained the steps of forming a milky white image formation and erasing the formed milky white image.

In the course of this 100-cycle image formation and erasure durability test, the density of the milky white image at the first cycle and that at the 100th cycle were measured by Macbeth Reflection Densitometer (RD-914).

The results of this 100-cycle image formation and erasure durability test are shown in TABLE 2.

TABLE 2

| | 100-cycle Image Formation & Erasure Durability Test | |
|---|---|---|
| | Density of Milky White Image at 1st Cycle | Density of Milky White Image at 100th Cycle |
| Ex. 10 | 0.77 | 1.02 |
| Ex. 11 | 0.76 | 0.80 |

The thermal pressure level differences of the reversible thermosensitive recording media No. 10 and No. 11 of the present invention were respectively measured to be 59% and 12%.

Japanese Patent Application No. 5-243879 filed on Sep. 3, 1993 is hereby incorporated by reference.

What is claimed is:

1. A reversible thermosensitive recording medium comprising a reversible thermosensitive recording layer which comprises a matrix resin and an organic low-molecular material which is dispersed in said matrix resin, the transparency of said reversible thermosensitive recording layer being reversibly changeable depending upon the temperature of said reversible thermosensitive recording layer, wherein said reversible thermosensitive recording layer has a softening initiation temperature $T_A$, said organic low-molecular-weight material has a higher crystallization temperature $T_{B1}$ which is 80° C. or more and a lower crystallization temperature $T_{B2}$, said softening initiation temperature $T_A$ is between said higher crystallization temperature $T_{B1}$ and said lower crystallization temperature $T_{B2}$, and said higher crystallization temperature $T_{B1}$ and said lower crystallization temperature $T_{B2}$ satisfies the relationship of $T_{B1}-T_{B2} \geqq 40°$ C.

2. The reversible thermosensitive recording medium as claimed in claim 1, wherein said softening initiation temperature $T_A$ and said higher crystallization temperature $T_{B1}$ satisfies the relationship of $T_{B1}-T_A \geqq 10°$ C.

3. The reversible thermosensitive recording medium as claimed in claim 2, wherein said softening initiation temperature $T_A$ and said higher crystallization temperature $T_{B1}$ satisfies the relationship of $T_{B1}-T_A \geqq 10°$ C.

4. The reversible thermosensitive recording medium as claimed in claim 2, wherein said softening initiation temperature $T_A$ is 80° C. or more.

5. The reversible thermosensitive recording medium as claimed in claim 4, wherein said lower crystallization temperature $T_{B2}$ is 35° C. or more.

6. The reversible thermosensitive recording medium as claimed in claim 2, wherein said lower crystallization temperature $T_{B2}$ is 35° C. or more.

7. The reversible thermosensitive recording medium as claimed in claim 1, wherein said softening initiation temperature $T_A$ and said lower crystallization temperature $T_{B2}$ satisfies the relationship of $T_A - T_{B2} \geqq 10°$ C.

8. The reversible thermosensitive recording medium as claimed in claim 7, wherein said softening initiation temperature $T_A$ and said lower crystallization temperature $T_{B2}$ satisfies the relationship of $T_A - T_{B2} \geqq 20°$ C.

9. The reversible thermosensitive recording medium as claimed in claim 7, wherein said softening initiation temperature $T_A$ is 80° C. or more.

10. The reversible thermosensitive recording medium as claimed in claim 7, wherein said lower crystallization temperature $T_{B2}$ is 35° C. or more.

11. The reversible thermosensitive recording medium as claimed in claim 1, wherein said softening initiation temperature $T_A$ is 80° C. or more.

12. The reversible thermosensitive recording medium as claimed in claim 11, wherein said lower crystallization temperature $T_{B2}$ is 35° C. or more.

13. The reversible thermosensitive recording medium as claimed in claim 1, wherein said lower crystallization temperature $T_{B2}$ is 35° C. or more.

14. The reversible thermosensitive recording medium as claimed in claim 13, wherein said lower crystallization temperature $T_{B2}$ is 35° C. or more.

15. The reversible thermosensitive recording medium as claimed in claim 1, wherein said reversible thermosensitive recording layer has a thermal pressure level difference of 40% or less.

16. The reversible thermosensitive recording medium as claimed in claim 15, wherein said reversible thermosensitive recording layer has a thermal pressure level difference change ratio of 70% or less.

17. The reversible thermosensitive recording medium as claimed in claim 16, wherein said matrix resin is crosslinked.

18. The reversible thermosensitive recording medium as claimed in claim 17, wherein said matrix resin is crosslinked by use of a crosslinking agent.

19. The reversible thermosensitive recording medium as claimed in claim 17, wherein said matrix resin is crosslinked by electron beam or ultraviolet light radiation.

20. The reversible thermosensitive recording medium as claimed in claim 15, wherein said matrix resin is crosslinked.

21. The reversible thermosensitive recording medium as claimed in claim 20, wherein said matrix resin is crosslinked by use of a crosslinking agent.

22. The reversible thermosensitive recording medium as claimed in claim 20, wherein said matrix resin is crosslinked by electron beam or ultraviolet light radiation.

* * * * *

UNITED STATES PATENT AND TRADEMARK OFFICE

CERTIFICATE OF CORRECTION

PATENT NO. : 5,426,086

DATED : June 20, 1995

INVENTOR(S) : Yoshihiko HOTTA et al

It is certified that error appears in the above-identified patent and that said Letters Patent is hereby corrected as shown below:

Column 2, line 46, "thereof will readily" should read --thereof will readily be--.

Column 5, line 42, "resin become to follow" should read --resin to follow--.

Column 18, line 58, "polyvinayl alcohol" should read --polyvinyl alcohol--.

Column 19, line 52, "CONH," should read -- —CONH,--.

Column 20, line 30, "be 16 or more,," should read --be 16 or more,--.

Column 23, line 32, "Tridecyl methacrlate" should read --Tridecyl methacrylate--.

Column 32, line 57, "solvent for use this" should read --solvent for use with this--.

UNITED STATES PATENT AND TRADEMARK OFFICE

CERTIFICATE OF CORRECTION

PATENT NO. : 5,426,086

DATED : June 20, 1995

INVENTOR(S) : Yoshihiko HOTTA et al

It is certified that error appears in the above-identified patent and that said Letters Patent is hereby corrected as shown below:

Column 39, line 68, "head my by Ricoh" should read --head made by Ricoh--.

Column 40, line 62, "$T_{B1} - T_A \geqq 10°C$" should read --$T_{B1} - T_A \geqq 20°C$--.

Signed and Sealed this

Thirteenth Day of August, 1996

*Attest:*

*Attesting Officer*

BRUCE LEHMAN

*Commissioner of Patents and Trademarks*